US011796281B1

(12) United States Patent
Chang

(10) Patent No.: US 11,796,281 B1
(45) Date of Patent: Oct. 24, 2023

(54) MULTI-TUBE GRENADE FOR A TOY LAUNCHER

(71) Applicant: Acetk Corp Ltd., New Taipei (TW)

(72) Inventor: Yung-Hui Chang, New Taipei (TW)

(73) Assignee: ACETK CORP LTD., New Taipei (TW)

( * ) Notice: Subject to any disclaimer, the term of this patent is extended or adjusted under 35 U.S.C. 154(b) by 0 days.

(21) Appl. No.: 18/328,976

(22) Filed: Jun. 5, 2023

Related U.S. Application Data

(60) Provisional application No. 63/355,155, filed on Jun. 24, 2022.

(51) Int. Cl.

| | |
|---|---|
| ***F42B 8/26*** | (2006.01) |
| ***F42B 27/00*** | (2006.01) |
| ***F41B 11/89*** | (2013.01) |
| ***F41B 11/55*** | (2013.01) |

(52) U.S. Cl.
CPC ..... *F41B 11/55* (2013.01); *F42B 8/26* (2013.01); *F42B 27/00* (2013.01)

(58) Field of Classification Search
CPC .. F42B 8/26; F42B 27/00; F41B 11/55; F41B 11/56; F41B 11/89; A63H 33/00
USPC ..... 124/55, 56, 71, 45, 59; 446/473; 102/498, 482
See application file for complete search history.

(56) References Cited

U.S. PATENT DOCUMENTS

| | | | | | |
|---|---|---|---|---|---|
| 3,878,639 | A * | 4/1975 | Scheelar | F42B 12/50 | 434/11 |
| 4,944,521 | A * | 7/1990 | Greeno | F42B 12/50 | 473/577 |
| 5,354,225 | A * | 10/1994 | Hix | A63H 33/30 | 102/482 |
| 5,590,886 | A * | 1/1997 | Lush | F42B 8/26 | 473/577 |
| 5,996,503 | A * | 12/1999 | Woodall | F42B 8/26 | 102/482 |
| 6,453,819 | B1 * | 9/2002 | Coates | F42B 8/26 | 102/513 |
| 6,871,594 | B1 * | 3/2005 | Estrella | F42B 27/00 | 473/577 |
| 7,059,316 | B1 * | 6/2006 | Tseng | F41B 11/00 | 102/440 |
| 7,275,486 | B2 * | 10/2007 | Hsieh | F42B 8/26 | 102/482 |
| 7,338,343 | B2 * | 3/2008 | Siu | F42B 8/26 | 102/498 |
| 7,784,455 | B1 * | 8/2010 | Chong | F41B 11/62 | 124/75 |
| 8,517,005 | B2 * | 8/2013 | Chu | F42B 12/56 | 124/71 |

(Continued)

FOREIGN PATENT DOCUMENTS

| | | |
|---|---|---|
| EP | 2 573 499 B1 | 2/2014 |
| JP | 5674626 B2 | 2/2015 |

*Primary Examiner* — Alexander R Niconovich
(74) *Attorney, Agent, or Firm* — McClure, Qualey & Rodack, LLP

(57) ABSTRACT

A toy grenade, designed for launching large numbers of plastic BBs at once, consists of a cylindrical shell with an O-ring interface. The cylindrical shell has circumferentially angled guide portions that allow the O-ring to flex inwardly when moved towards the remote ends. As a result, users can safely unload all the BBs if they wish to do so.

2 Claims, 25 Drawing Sheets

(56) References Cited

U.S. PATENT DOCUMENTS

| | | | | |
|---|---|---|---|---|
| 8,707,939 | B2 * | 4/2014 | Chu | F41B 7/006 124/45 |
| 8,925,538 | B2 * | 1/2015 | Chong | F42B 12/36 102/370 |
| 10,190,843 | B2 * | 1/2019 | Chong | F42B 8/02 |
| 10,443,970 | B2 * | 10/2019 | Radl | F41A 21/06 |
| 11,371,799 | B2 * | 6/2022 | Chong | F41B 11/642 |
| 2023/0132075 | A1 * | 4/2023 | Tseng | F41B 11/62 102/482 |

* cited by examiner

MULTI-TUBE GRENADE FOR A TOY LAUNCHER

CROSS-REFERENCE TO RELATED APPLICATIONS

This application claims the benefit of U.S. Provisional Application No. 63/355,155, which was filed on Jun. 24, 2022, and is incorporated herein by reference.

PRIOR ART

A conventional multi-tube grenade (e.g., a structure of grenade described in U.S. Pat. No. 8,517,005B2) in the market, adaptable for use with a toy launcher, typically includes a bullet compartment (having circumferentially arranged cylinders arranged to allow each of the accommodation cylinders to receive, via a front opening thereof, and load BB bullets or paintballs therein); a gas-fed storage chamber; an actuation rod assembly; a few activation members (e.g., primer); and a rubber ring that is fixedly positioned in a circumferential trough (i.e., a groove described in U.S. Pat. No. 10,443,970B2) adjacent said front openings of each of the circumferentially arranged cylinders. With the toy launcher (e.g., a toy projectile launcher described in EP patent EP2573499B1), the grenade can then simultaneously launch the entire plurality of bullets.

Unfortunately, loading large numbers of BB bullets into multi-tube grenades is time-consuming. Each time, sufficient pressure is required to push the BB bullet past the rubber ring adjacent said front openings. If the grenade has 10 accommodation cylinders, and each cylinder can hold multiple BB bullets, the user will need to repeat the process several times, one by one. A device that can facilitate easier reloading of such grenades would be highly beneficial.

Moreover, after loading large numbers of BB bullets into conventional grenades, the user cannot safely unload the BB bullets since the fixedly positioned rubber ring blocks and prevents the BB bullets from dropping off. The user has no choice but to unload the BB bullets by triggering and releasing the compressed air in the gas-fed storage chamber, thereby ejecting all the BB bullets contained within.

BACKGROUND OF THE INVENTION

The present invention relates to a toy grenade designed for launching large numbers of bullets simultaneously, as well as a toy grenade capable of unloading the bullets when necessary.

SUMMARY OF THE INVENTION

The present invention provides a different kind of toy grenade, for launching large numbers of bullets at a time, comprising a cylindrical shell wherein the cylindrical shell includes a plurality of accommodation cylinders and a circumferential extension, the circumferential extension having a holding portion which extends about a centerline to provide an annular surface for slidably mounting a flexible rubber ring. The flexible rubber ring blocks and prevents the bullets from dropping off only when being adjacent the rearward end (near the front openings of the cylinders). Since the rubber ring is not provided in a fixed position, the user may move the rubber ring toward the remote end (the term 'remote' means toward the front direction away from the cylinders), and then pour out all bullets when needed.

The invention relates, in another embodiment, a toy grenade for launching large numbers of bullets at once, comprising a cylindrical shell that includes a plurality of circumferentially arranged accommodation cylinders, and a plurality of circumferentially arranged extensions over which the extensions are configured to slidably mount the flexible rubber ring. The plurality of circumferentially arranged extensions extend substantially about a centerline axis to define a bore opening through which a rubber ring interface (or other switching assemblies) may be movably mounted therein since there are a plurality of gaps between the plurality of circumferentially arranged extensions.

The invention relates, in another embodiment, a toy grenade for launching large numbers of bullets at once, comprising a cylindrical shell that includes a central bore, around which a plurality of circumferentially arranged accommodation cylinders are configured to allow each of the cylinders to receive bullets, the cylindrical shell further including a plurality of circumferentially arranged holding portions, adjacent each of the front openings of the cylinders, extending about a centerline for providing a non-continuous annular surface to mount a flexible rubber ring, wherein the rubber ring can be easily replaced by the user if desired.

The invention relates, in another embodiment, the toy grenade further comprising a storage chamber, which is in communication with the cylindrical shell and is delimited by a first inner edge and a second inner edge respectively at front end and rear end thereof; an actuation rod assembly, which is hollow and is received in a central bore of the cylindrical shell and comprises an air inlet tube arranged at a front side thereof, the air inlet tube having a front end forming an air inlet opening and a rear end to which a front radial extension and a back radial extension are mounted, an air output opening being formed between the front radial extension and the back radial extension, the front radial extension and the back radial extension each having a circumference around which a gasket ring is mounted to set the gasket rings in engagement with the first inner edge and the second inner edge of the storage chamber so as to hermetically seal the storage chamber, wherein the front radial extension has a smaller flange at the forward side than a wider flange at the rearward side for limiting the actuation rod assembly to move backwardly when releasing the compressed air in the storage chamber.

The compressed air is allowed to feed through the air inlet opening of the air inlet tube and the compressed air is discharged through the air output opening to accumulate in the storage chamber. When in percussion, a trigger of a toy launcher is structured to move the actuation rod assembly backward to disengage the front radial extension from the first inner edge of the storage chamber so as to release the compressed air in the storage chamber to instantaneously eject the BB bullets received in the cylindrical shell. These and other objectives of the present invention will no doubt become obvious to those of ordinary skill in the art after reading the following detailed description of the preferred embodiment that is illustrated in the various figures and drawings.

DETAILED DESCRIPTION OF THE INVENTION

Reference will now be made in detail to embodiments, examples of which are illustrated in the accompanying drawings. In the following detailed description, numerous specific details are set forth to provide a thorough understanding of the present invention. However, it will be apparent to one of ordinary skill in the art that the present invention may be practiced without these specific details. In other instances, well-known methods, components, have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first body described in FIG. 7E could be termed a second body, and, similarly, a second body could be termed a first body, without departing from the scope of the present invention. The terminology used in the description of the invention herein is for the purpose of describing particular embodiments only and is not intended to be limiting of the invention. For example, airsoft pellets (known as BBs) are spherical projectiles (made of plastic) used by airsoft guns. Hereinafter all referred to as "BB bullets" or "BBs" but is not intended to be limiting of the invention.

As used in the description of the invention and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

Figure 1A:
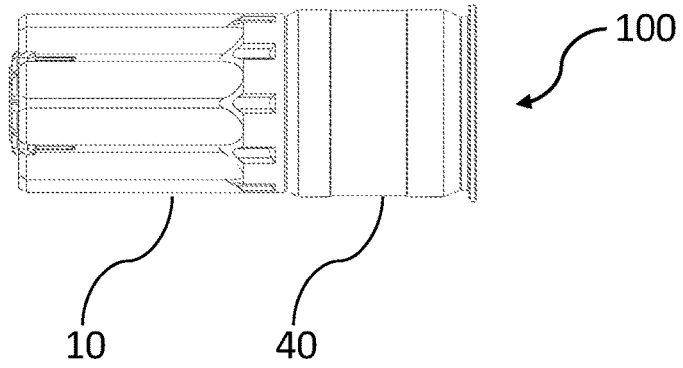
FIGS. 1A-1C illustrate a circumferentially arranged extension that defines an annular surface for the slidable mounting of a flexible rubber ring.
Figure 1B:
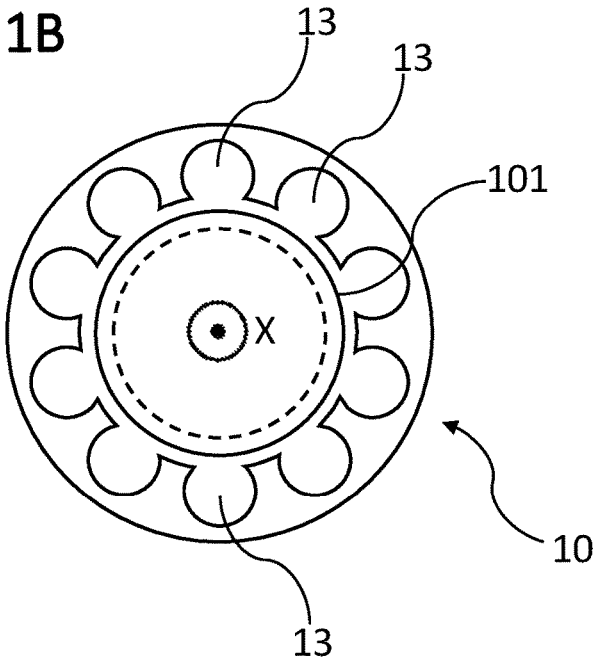
Figure 1C:
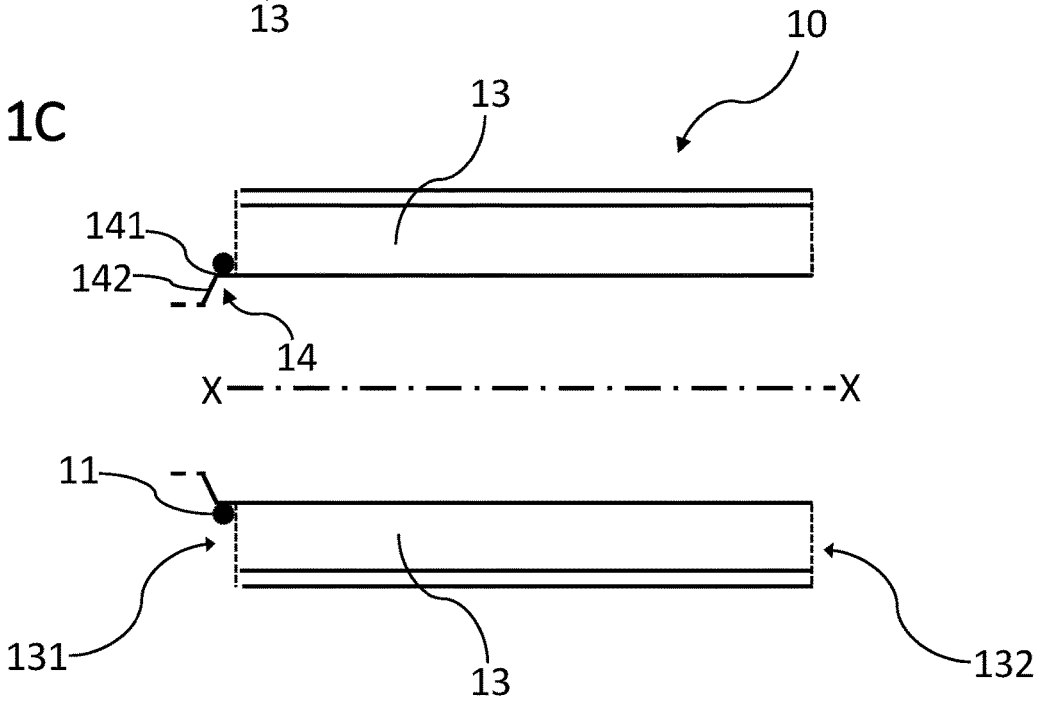

As shown in FIG. 1A, the toy grenade 100 consists of a cylindrical shell 10 designed for launching many BB bullets (hereinafter simply referred to as "BBs") or paintballs at once. The grenade includes the cylindrical shell 10 and a gas storage chamber 40, which enables it to be gas-fed and capable of launching all the BBs simultaneously. In FIGS. 1B and 1C, the cylindrical shell 10 is depicted, comprising multiple accommodation cylinders 13 and a circumferential extension 14 positioned adjacent to the inner circumference 101 of the shell. The extension 14 extends around the centerline axis X and is characterized by a holding portion 141, which forms a first annular surface for the sliding placement of a flexible rubber ring 11. Additionally, a guide portion 142 is located downstream from the first annular surface and is inwardly angled relative to it. This structure allows the shell 10 to have a tapered tubular nozzle that facilitates the sliding mounting of the flexible rubber ring.

The terms "forward" and "rearward" in relation to the cylindrical shell 10 refer to the directions toward the front openings 131 side and the back openings 132 side, respectively. The terms "inner" or "inward" indicate a radial direction toward the centerline axis X, while "outer" or "outward" indicate a radial direction away from the centerline axis X.

Figure 2A:
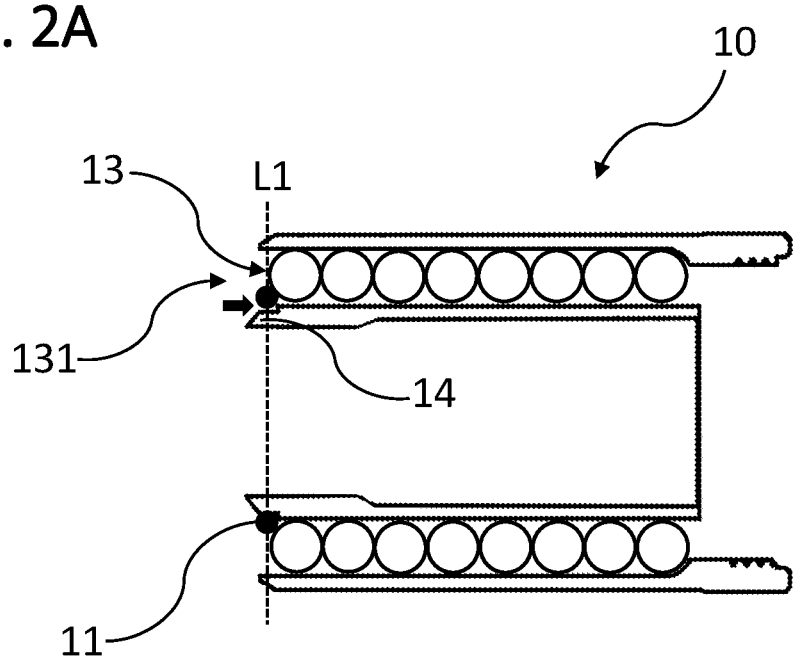
FIGS. 2A-2B illustrate a cylindrical shell that is configured to allow the flexible rubber ring to flex inwardly when it is pushed toward the forward ends during the launching process.
Figure 2B:
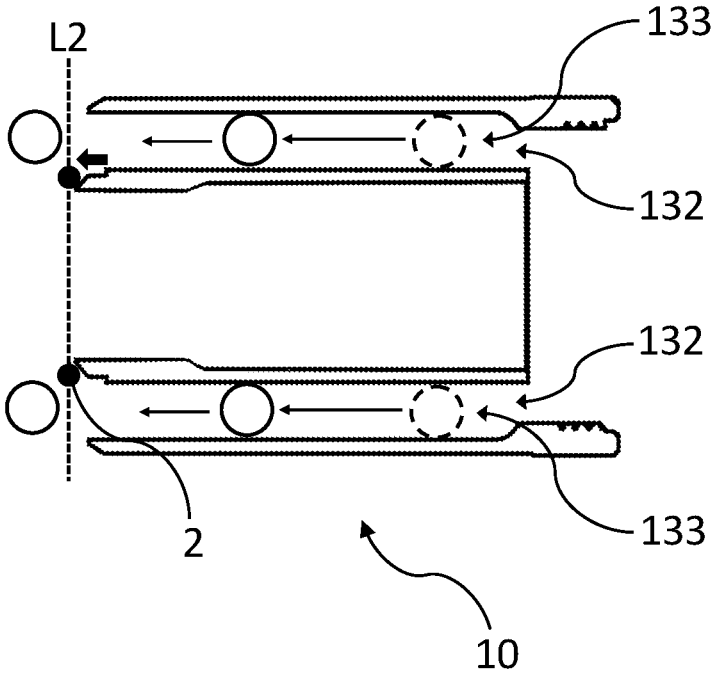

In one embodiment, as depicted in FIGS. 2A and 2B, the user can load a substantial number of BBs into each accommodation cylinder 13 (referred to as "cylinder 13" hereinafter). Subsequently, the flexible rubber ring 11 is mounted onto the extension 14. During the launching process (shown in FIG. 8B), gas pressure accumulates behind all the cylinders 13 and enters each cylinder 13 through the back openings 132. As a result, the BBs push the rubber ring 11 towards the front end of the extension 14. The dimensions of the extension 14 are configured to ensure that the rubber ring 11 does not obstruct the trajectory channels 133 after the launching process. For instance, the rubber ring 11 may block and prevent BBs from falling off when positioned at the first annular surface (referred to as "location L1") adjacent to the front openings 131 of the cylinders 13. Conversely, the guide portion 142 of the extension 14 is designed to allow the ring 11 to flex inwardly when pushed by the BBs from location L1 towards the forward ends (referred to as "location L2") of the extension 14. The flexible ring 11 can flex either outwardly or inwardly while sliding between location L1 and location L2. Notably, the flexible ring 11 has a larger circumference at location L1 than at location L2.

The structure of the tapered tubular nozzle incorporates an annular surface with a tapered portion, enabling the flexible rubber ring to flex both outwardly and inwardly as it moves along the surface. The circumferential extension includes an inwardly angled guide portion, allowing the flexible rubber ring 11 to flex inwardly when moved towards the remote end of the circumferential guide portion. The guide portion extends from the holding portion and is angled relative to it, providing a second annular surface that permits the rubber ring 11 to flex either outwardly or inwardly as it moves along the surface.

Figure 3A:
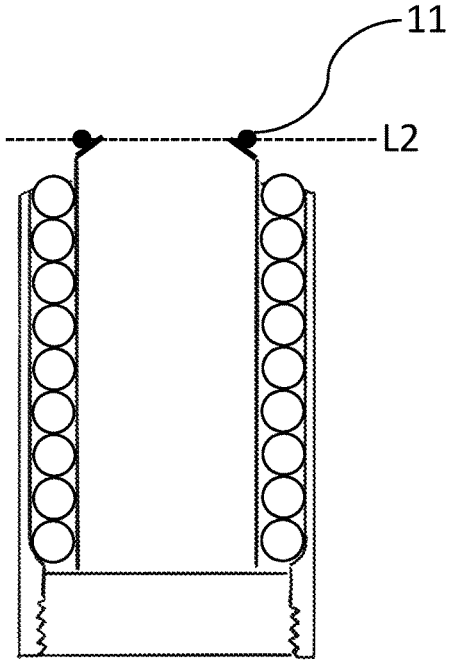
FIGS. 3A-3C illustrate a reloading method in accordance with certain embodiments.
Figure 3B:
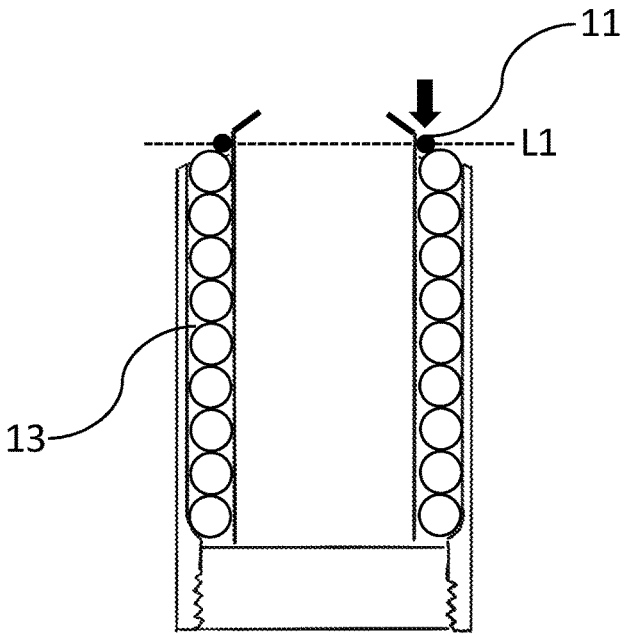
Figure 3C:
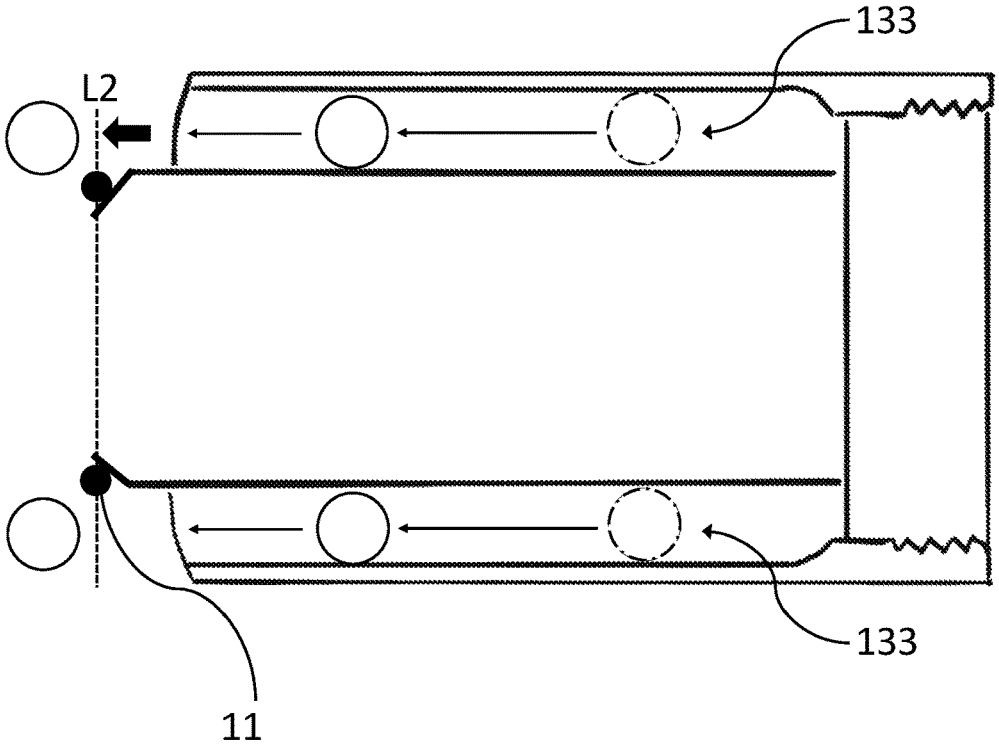

In another embodiment of the cylindrical shell 10, as depicted in FIGS. 3A, 3B, and 3C, a method is presented comprising the following steps: a) reloading BBs into the cylinders 13 while the ring 11 is at location L2; b) pushing the ring 11 from location L2 to location L1; c) releasing the compressed air (i.e., pressurized gas) within the grenade 100 to eject the BBs stored inside. The circumferential extension is designed to prevent BBs from falling off when the flexible ring 11 is positioned at location L1. During the launching process, the BBs push the ring 11 from location L1 towards location L2. The tapered portion (circumferential guide portion) of the tubular nozzle is configured to ensure that the ring 11 no longer interferes with the trajectory channels 133 after being pushed to location L2, thereby avoiding horizontal overlap with the projectile passages.

Figure 4:
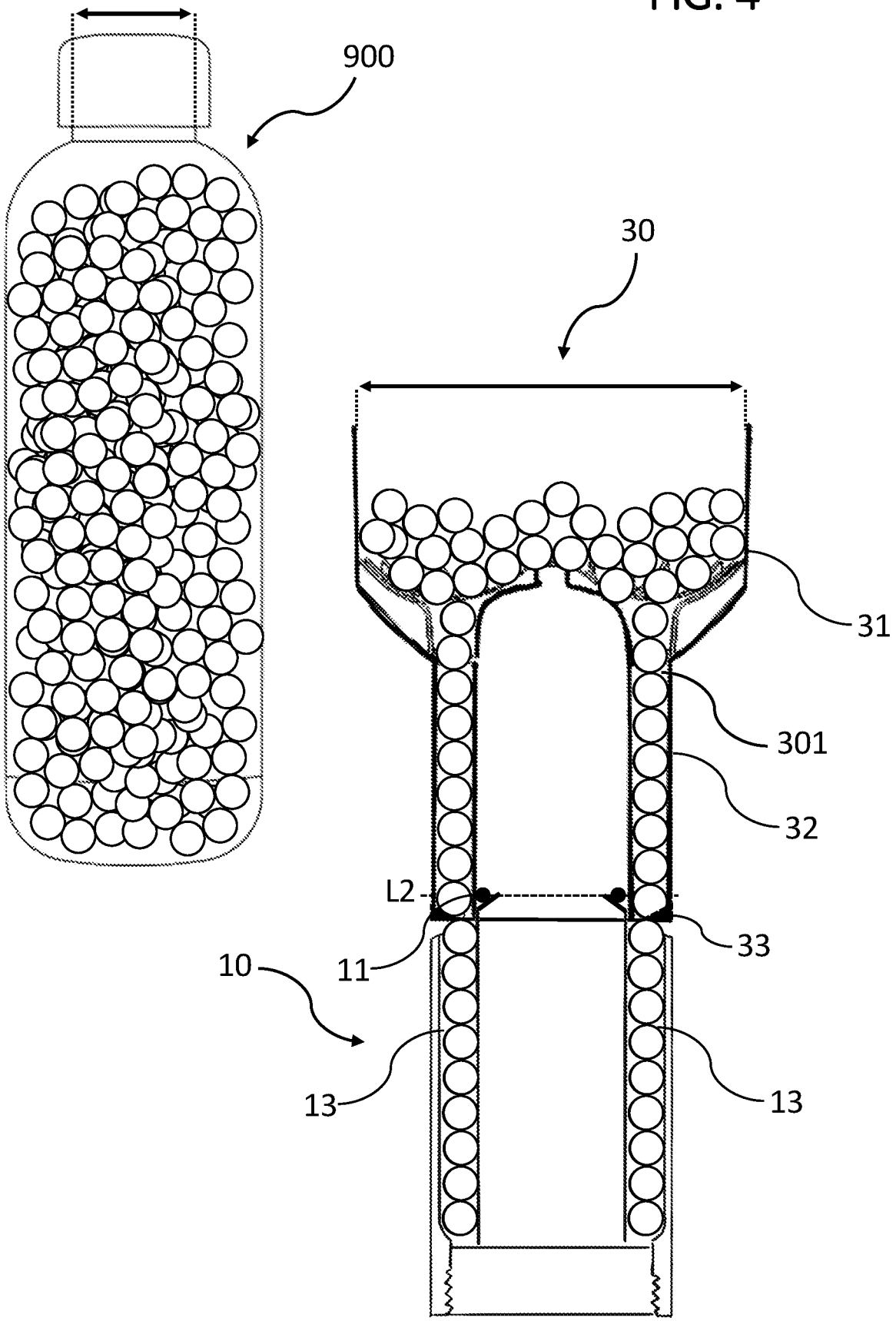
FIG. 4 illustrates a loading device designed to load a significant number of BBs into each accommodation cylinder of the cylindrical shell simultaneously.

The inclusion of a circumferentially tapered guide portion facilitates the smooth movement of the flexible rubber ring 11 from one position to another (such as location L2, where the ring 11 does not hinder the reloading of BBs). This design allows the user to reload the next round of BBs more quickly after launching, as no pressure is required to push the BBs through the rubber ring 11. With this in mind, an embodiment shown in FIG. 4 introduces a BB bullet loading device 30 designed to load a significant number of BBs into each accommodation cylinder 13 of the cylindrical shell 10 simultaneously.

The loading device 30 comprises a body with an upper cup portion 31 and a lower output portion 32. The cup portion 31 features an opening larger than the openings of typical BBs packages (e.g., BBs package bottle 900) and is designed to receive BBs. The lower output portion 32 consists of a plurality of circumferentially arranged BBs queue tubes 301, responsible for dispensing BBs into the cylinders 13 of the cylindrical shell 10. To prevent any accidental spillage, the loading device 30 is equipped with a movable stopper 33 positioned at the bottom side of the queue tubes 301, which can be used to block and prevent BBs from falling out when necessary.

Figure 5A:
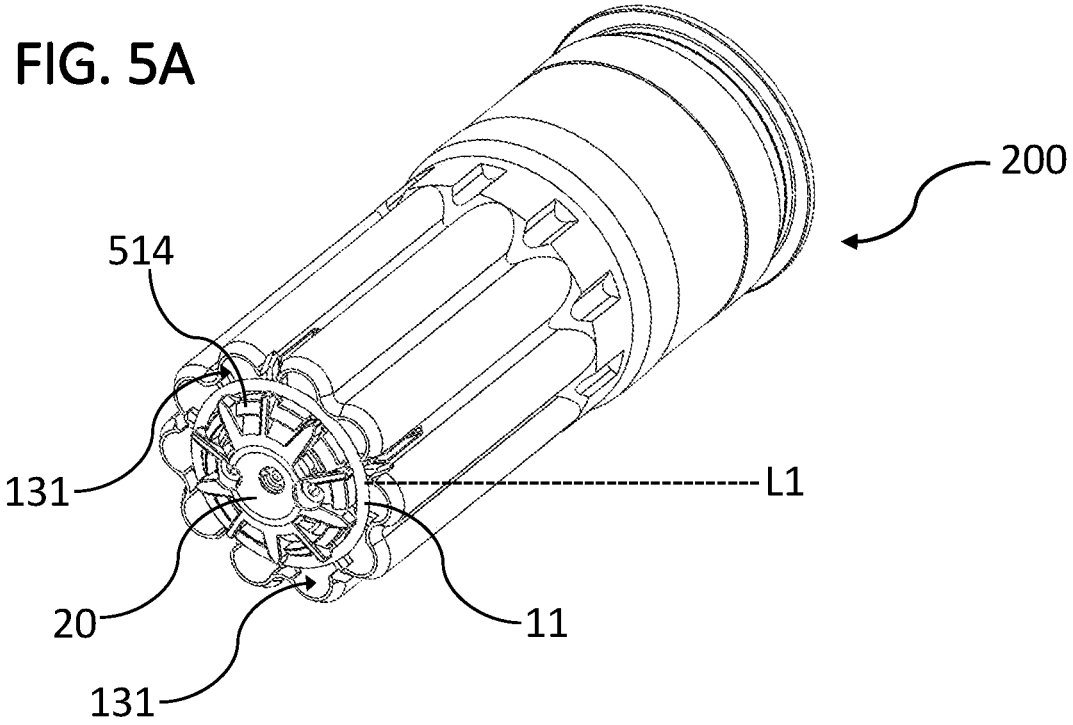
FIGS. 5A-5G illustrate another embodiment featuring a plurality of circumferentially arranged extensions that define a non-continuous annular surface for receiving and holding the rubber ring.
Figure 5B:
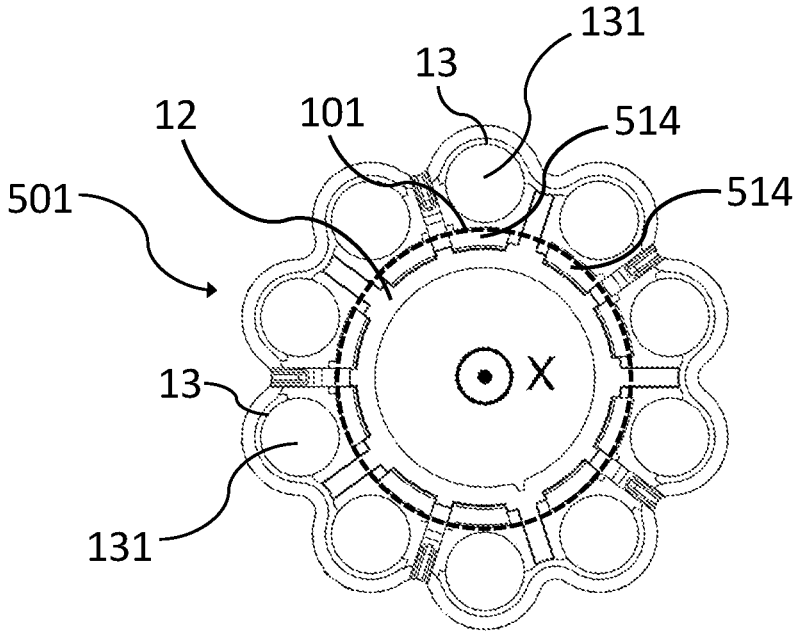
Figure 5C:
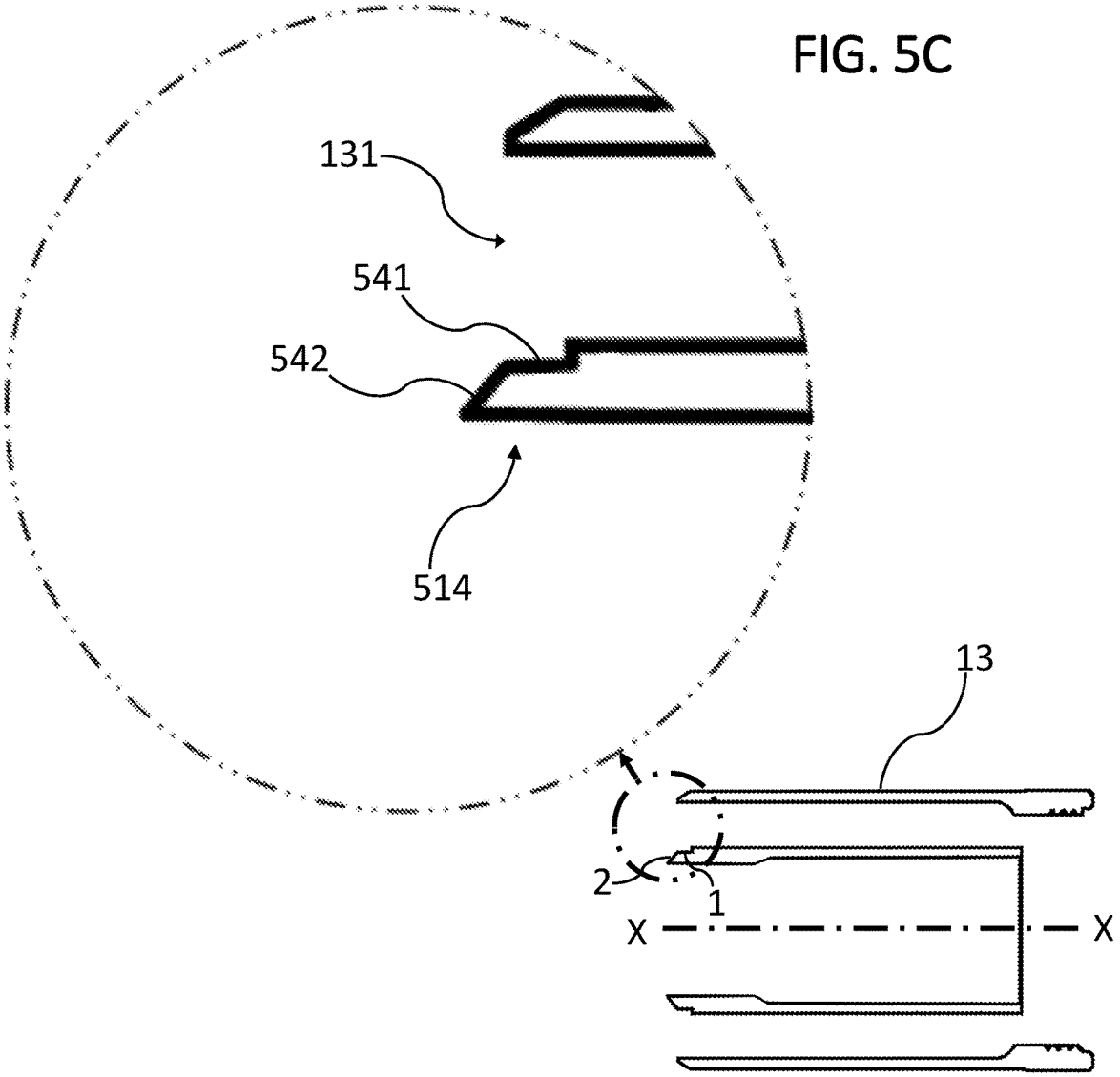
Figure 5D:
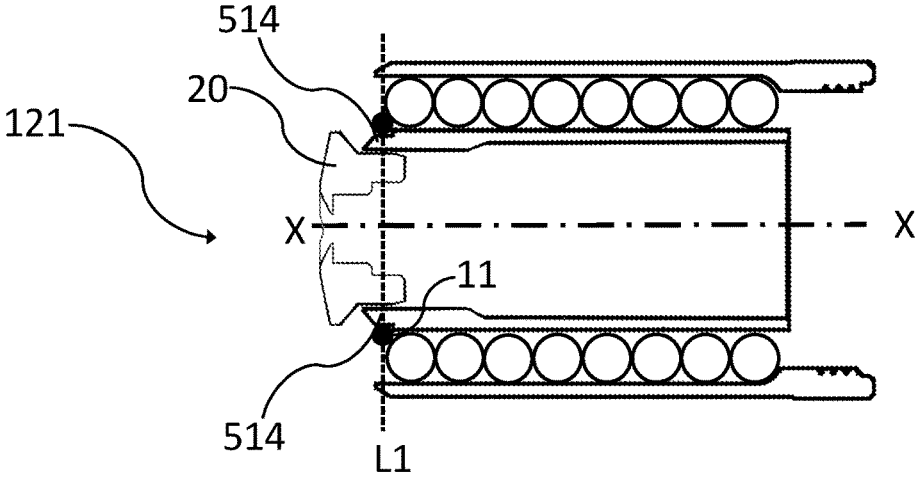
Figure 5E:
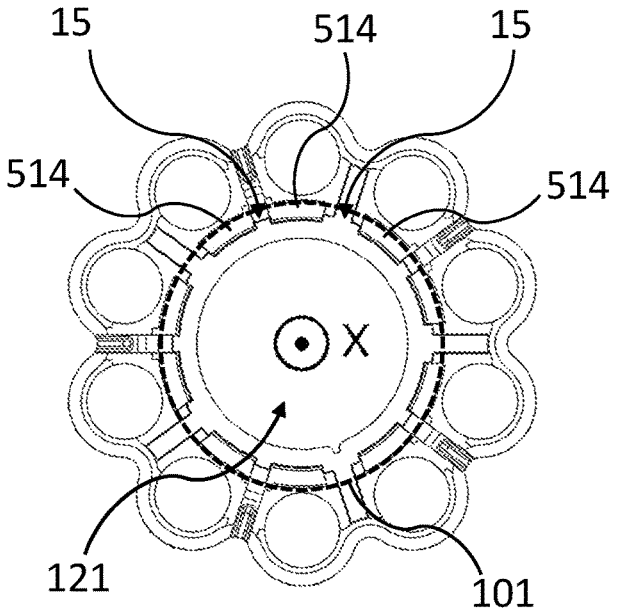
Figure 5F:
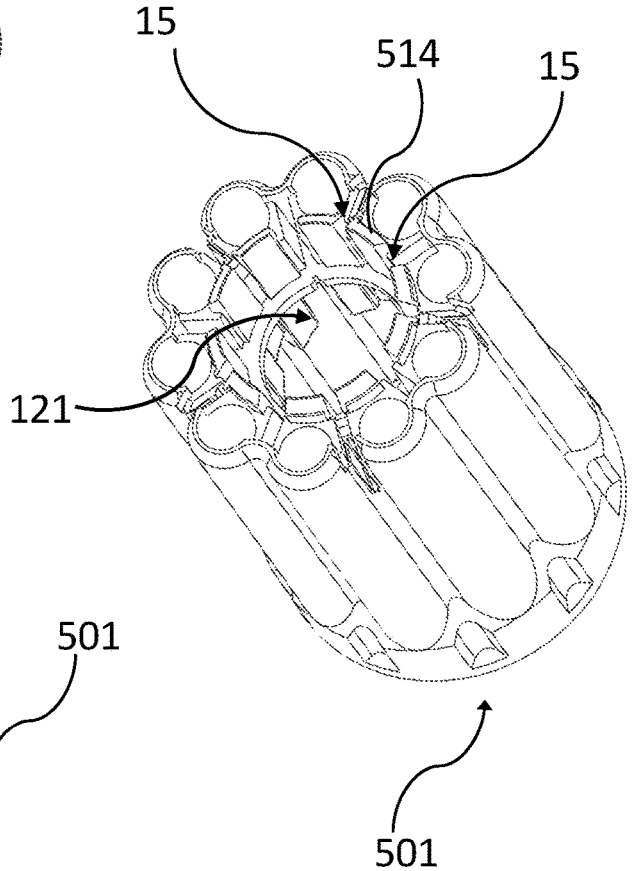
Figure 5G:
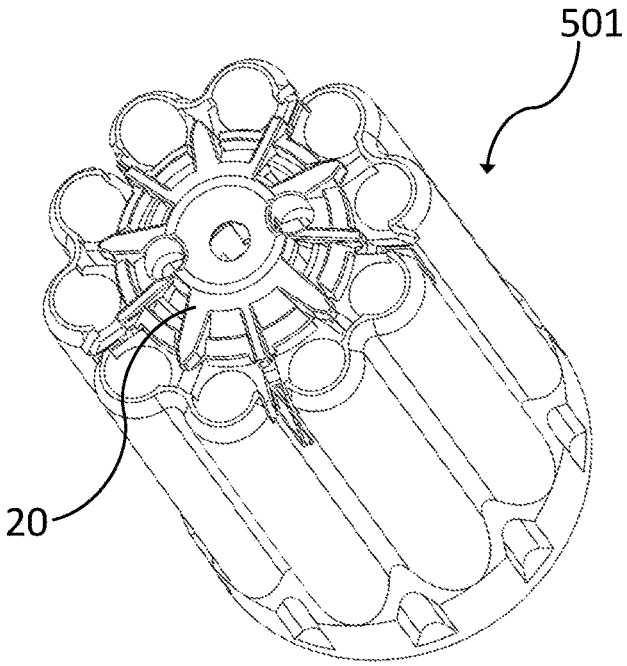

In another embodiment, as depicted in FIGS. 5A, 5B, and 5C, a toy grenade 200, such as the AceHive series launched by ACETECH, is designed for launching large numbers of BBs simultaneously. The grenade 200 comprises a cylindrical shell 501 featuring a central bore 12. The accommodation cylinders 13, arranged circumferentially around the central bore 12, are designed to accommodate BBs. Adjacent to the front openings 131 of the cylinders, there are circumferentially arranged holding portions 541. These holding portions 541 extend about the centerline X of the cylindrical shell, providing a non-continuous annular surface 1 for mounting the flexible rubber ring. In FIGS. 5C and 5D, the cylindrical shell 501 is shown to include additional circumferentially arranged guide portions 542. These guide portions 542 extend from each holding portion 541 and are angled relative to them, creating a second non-continuous annular surface 2. This second annular surface allows the rubber ring to flex outwardly or inwardly as it moves along it. To enable the movability of the ring interface 20, a series of circumferentially arranged extensions 514 extend substantially around the centerline axis X, defining a bore opening 121. The rubber ring interface 20, or simply the interface 20, can be mounted within this bore opening 121, taking advantage of the gaps 15 between the circumferentially arranged extensions 514, as depicted in FIGS. 5E, 5F, and 5G.

Figure 6A:
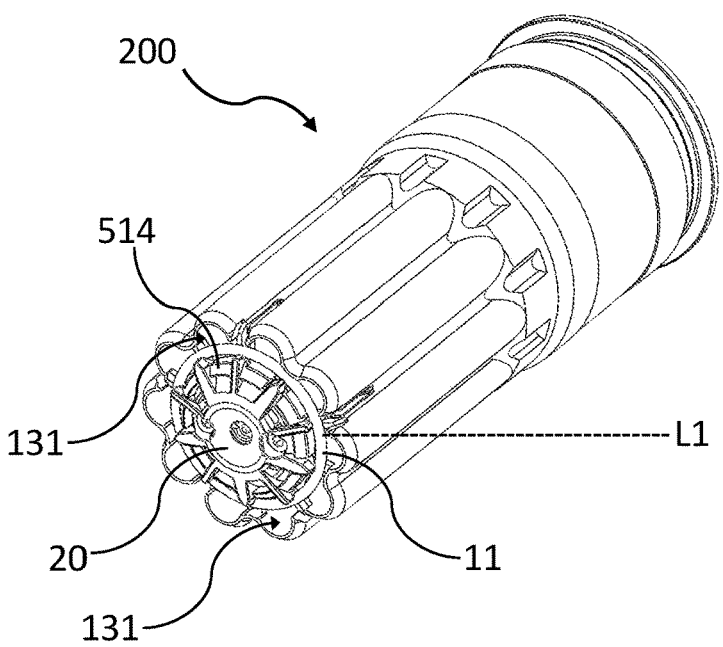
FIGS. 6A-6H illustrate another embodiment with a ring interface used to move the rubber ring to preferred locations.
Figure 6B:
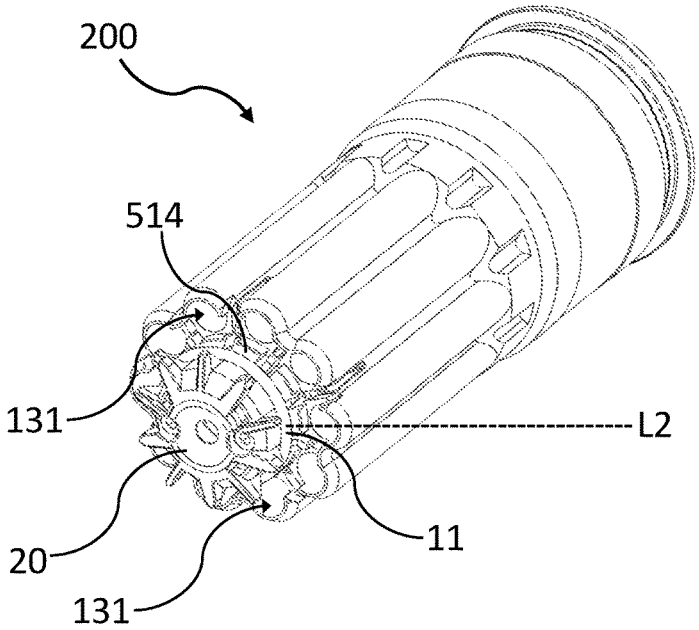
Figure 6C:
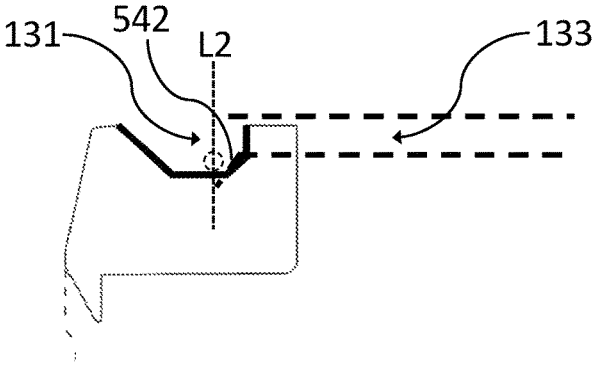

FIGS. 6A and 6B illustrate an embodiment of the grenade 200 featuring the interface 20. The ring 11 is capable of sliding between positions L1 and L2. When the grenade 200 releases compressed air, the BBs move forward, pushing the ring 11 from position L1 to position L2. The interface 20 is designed to stop and hold the ring 11 at a predetermined position, such as position L2. When the ring 11 is at position L2, users can reload the next round of BBs more quickly because the interface 20 ensures that the ring 11, in that position, does not interfere with any of the trajectory channels 133 depicted in FIG. 6C. To facilitate this functionality, the cylindrical shell may include a series of circumferentially arranged extensions 514, with gaps 15 between them. These gaps 15 allow for the movability of the interface 20, which can be mounted and move axially forward and rearward along the centerline axis X through these gaps 15. As a result, the interface 20 can relocate the ring 11 to preferred positions, such as position L1.

Figure 6D:
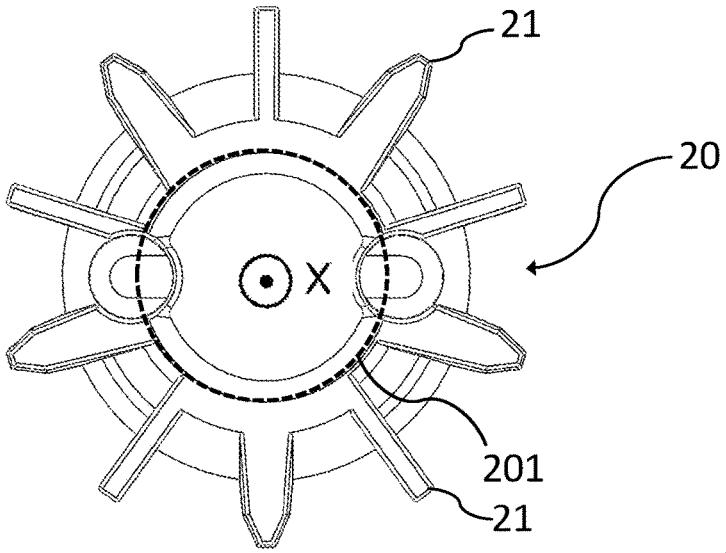
Figure 6E:
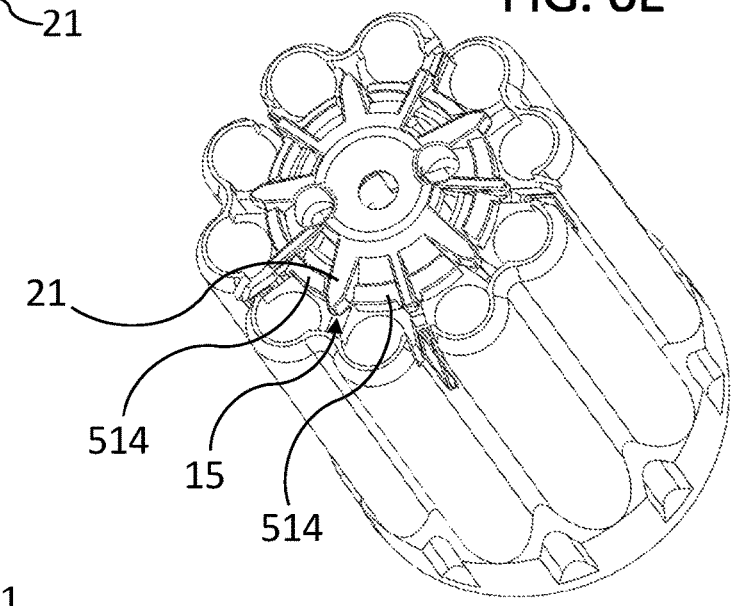
Figure 6F:
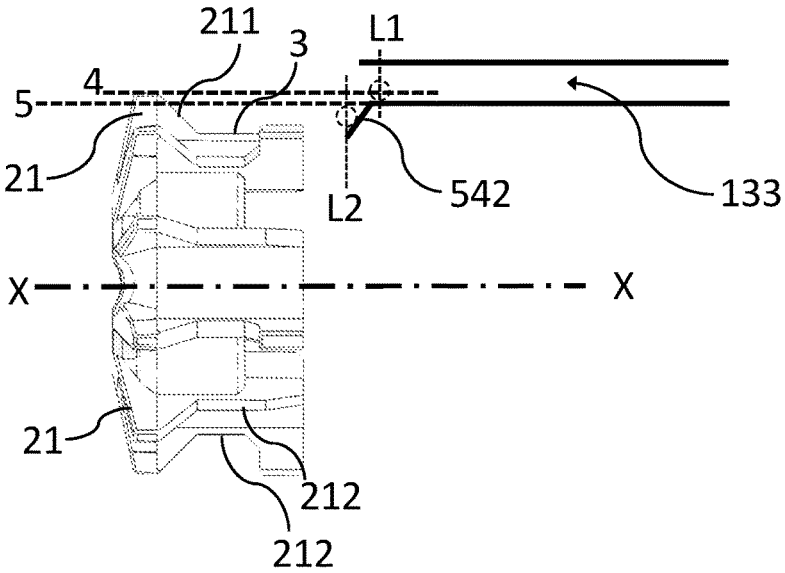

Referring to FIGS. 6D, 6E, and 6F, the interface 20 comprises multiple fins 21 arranged on its outer circumferential surface. These fins 21 are spaced apart at a predetermined distance, enabling them to be inserted into the gaps 15 between any two extensions 514 and push the ring 11 to preferred positions. Each fin 21 includes a second holding portion 212 that extends substantially around the centerline axis X. Furthermore, a rearward-facing portion 211 extends from the second holding portion 212 towards the forward side, angled outwardly. The circumferentially arranged second holding portions 212 create a third non-continuous annular surface 3, which receives and securely holds the ring 11 at the preferred positions.

The configuration of the multiple rearward-facing portions 211 is designed to push the ring 11 to position L1 (where the ring 11 is positioned on the first non-continuous annular surface). When the interface 20 is inserted into the bore opening 121 (as shown in FIGS. 5F and 5G), the rearward-facing portions 211, in conjunction with the guide surfaces 542, work together to move the ring 11 to position L1. The rearward-facing portions 211 can have the same inclined angle (but not limited to) relative to the centerline axis X. The multiple fins 21 are spaced apart to ensure they do not obstruct the trajectory channels 133. The height 4 of the fins 21 (relative to the centerline axis X) can be greater than the distance from the centerline axis X to the lowest point 5 of the trajectory channels 133 shown in FIG. 6F. By pushing into the bore opening 121, the multiple rearward-facing portions 211 of the fins 21 can push the ring 11 to position L1.

Figure 6G:
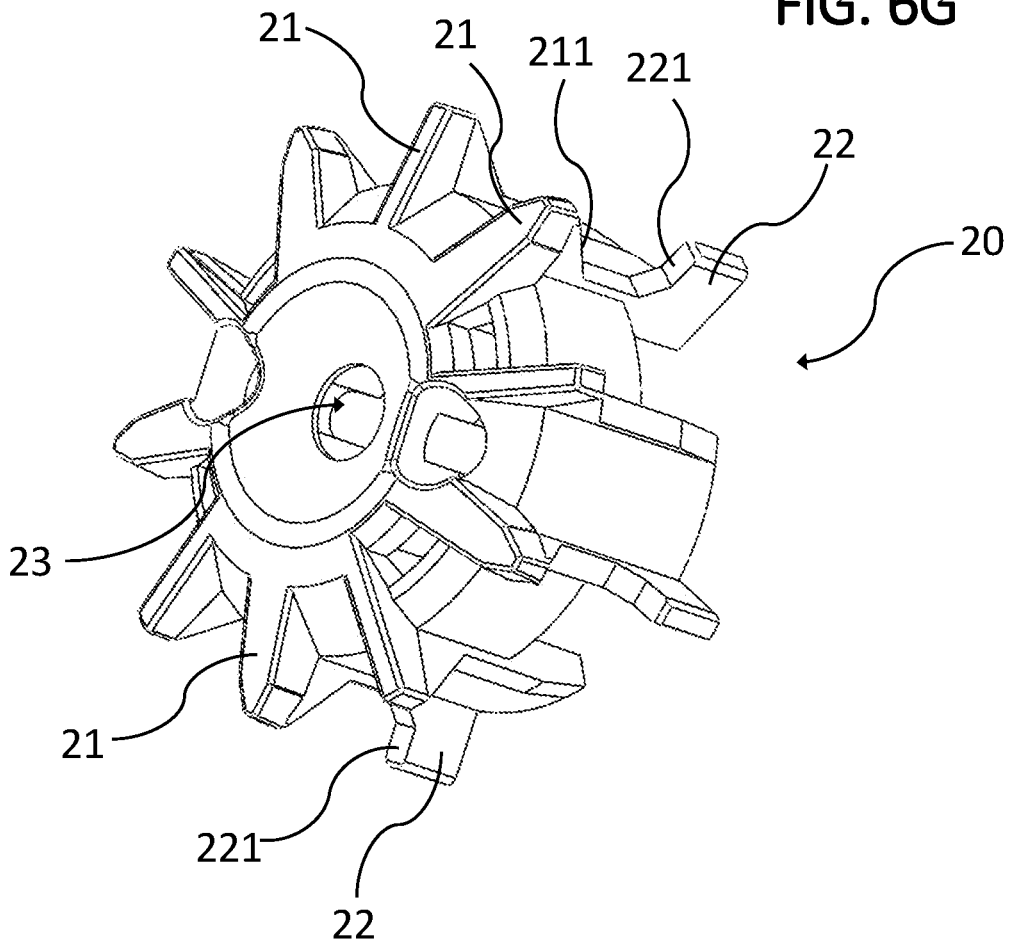
Figure 6H:
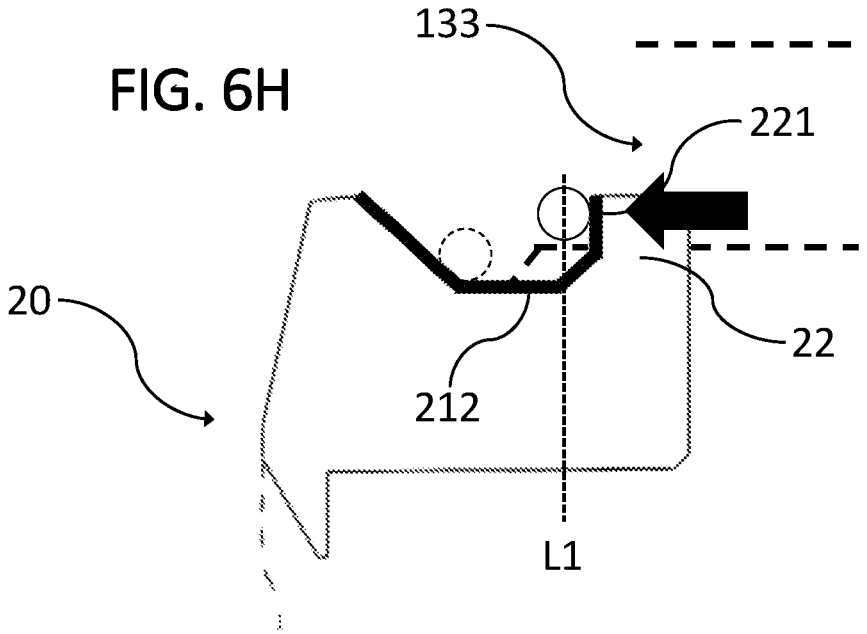

In FIGS. 6G and 6H, the shapes of the circumferentially arranged fins 21 vary for the purpose of assembly or positioning. The interface 20 may also include a plurality of back fins 22 positioned opposite to some of the circumferentially arranged fins 21. Each back fin 22 comprises a pulling portion 221, which faces toward the rearward-facing portions 211, and is used for pulling out the ring 11 when necessary. The pulling portion 221 extends outwardly away from the centerline axis X and preferably has a portion substantially orthogonal to the centerline axis X, as well as a beveled portion adjacent to the second holding portion 212. Additionally, the interface 20 may have a front hole 23 on the front side, providing user access to an air inlet opening 411 depicted in FIG. 8C.

Based on the described embodiment, the shell comprises the plurality of circumferentially arranged guide portions, allowing the rubber ring to flex inwardly when pushed toward the remote ends. The ring interface 20 includes the plurality of fins 21 arranged on its outer circumferential surface. Each fin 21 has a second holding portion that extends substantially about the centerline axis X, and a rearward-facing portion 211 extending from the second holding portion towards the forward side, angled outwardly relative to it. The plurality of circumferentially arranged second holding portions create the third non-continuous annular surface, which receives and holds the rubber ring at preferred positions. Additionally, the interface 20 may include the plurality of back fins 22 positioned opposite to some of the circumferentially arranged fins 21. These back fins 22 are designed to be inserted into the plurality of gaps 15 between the extensions 514. Consequently, the interface 20 can be positioned adjacent to the bore opening of the cylindrical shell and can slide axially forward and rearward. This allows the interface 20 to push or pull the rubber ring towards the preferred positions, such as L1 and L2.

Figure 7A:
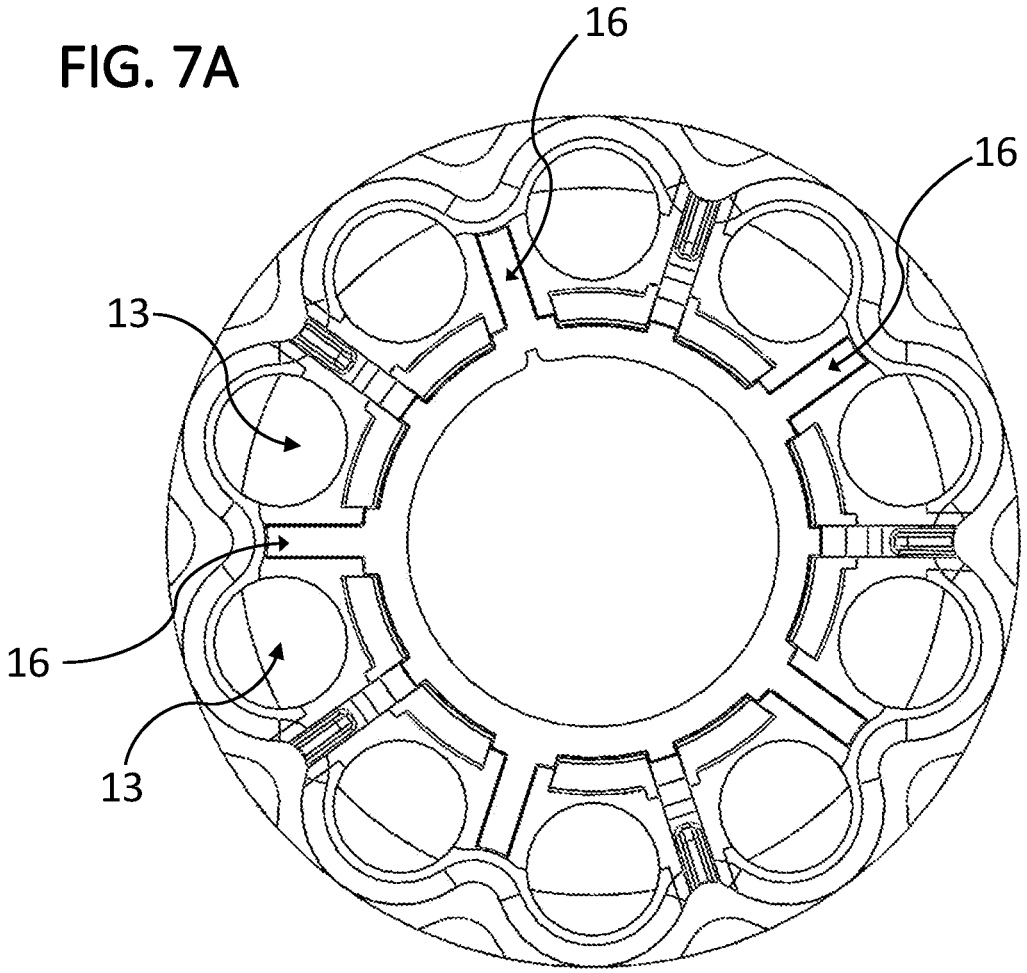
FIGS. 7A-7H illustrate another embodiment in which a switch assembly can axially move the ring interface relative to the cylindrical shell between preferred locations.
Figure 7B:
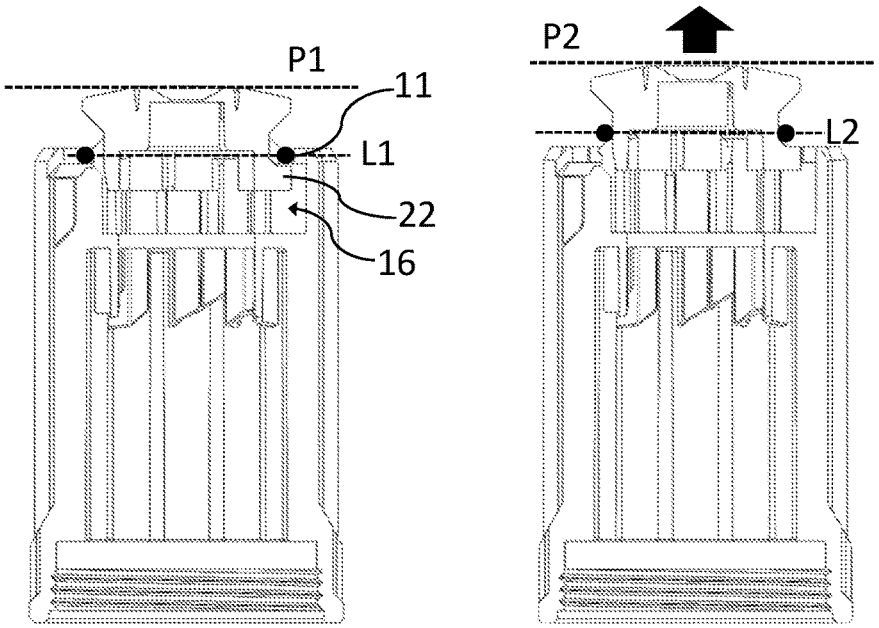

In FIG. 7A, the cylindrical shell 501 is shown to have a plurality of slots 16 between adjacent cylinders 13, which are used for inserting the plurality of back fins. This allows the grenade 200 to provide two stabilized positions for the interface 20 to interact with the ring 11. In FIG. 7B, the first stabilized position occurs when the ring 11 is at L1. At this position, the interface 20 is retracted to a low position, referred to as "position P1," where the back fins 22 do not interfere with the ring 11. The user can pull the ring 11 to L2 using the back fins 22 and then stabilize the interface 20 at a higher remote position, referred to as "position P2."

Figure 7C:
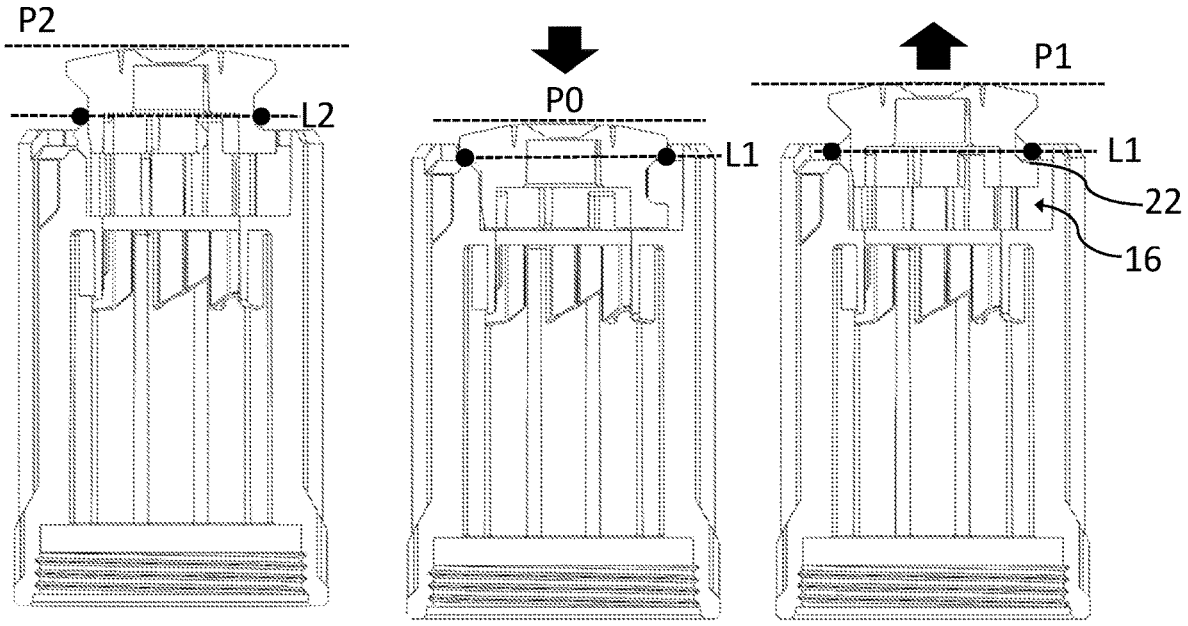

In FIG. 7C, when the user pushes the ring 11 from L2 to L1 using the interface 20, the location of the interface 20 will be at the lowest position, referred to as "position P0." The user can then stabilize the interface 20 back to position P1. To meet these requirements, the grenade 200 includes a switch assembly 70 (as shown in FIG. 7D) for axially moving the interface 20 relative to the shell 501 between the remote position (P2), the retracted position (P1), and an intermediate position (P0).

Figure 7D:
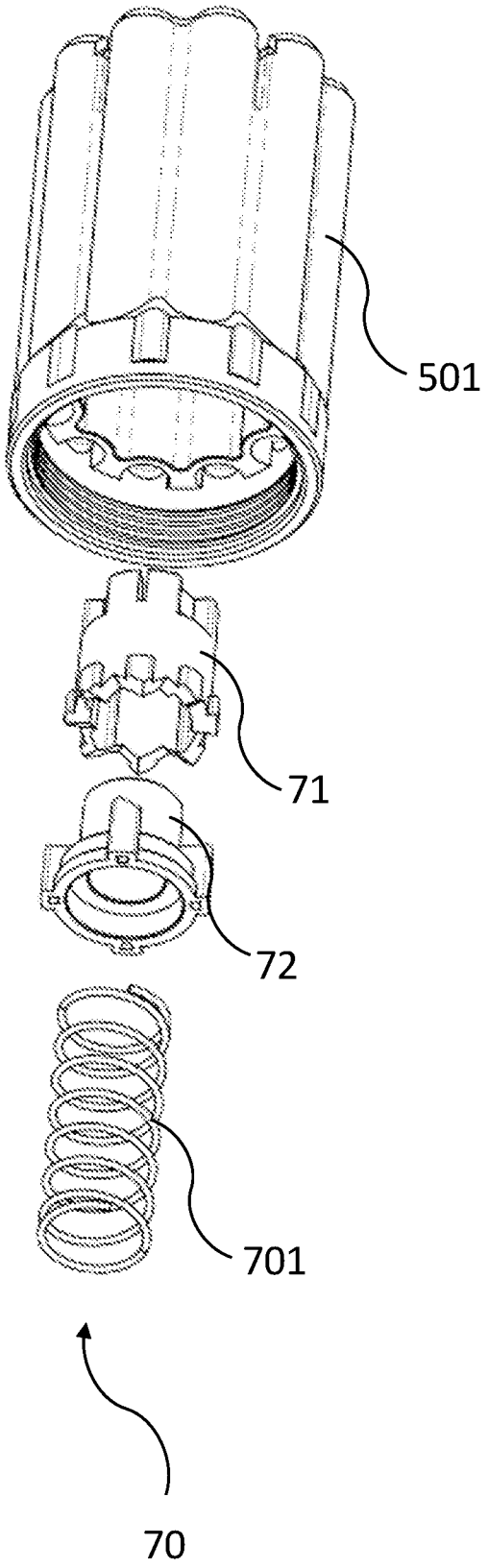
Figure 7E:
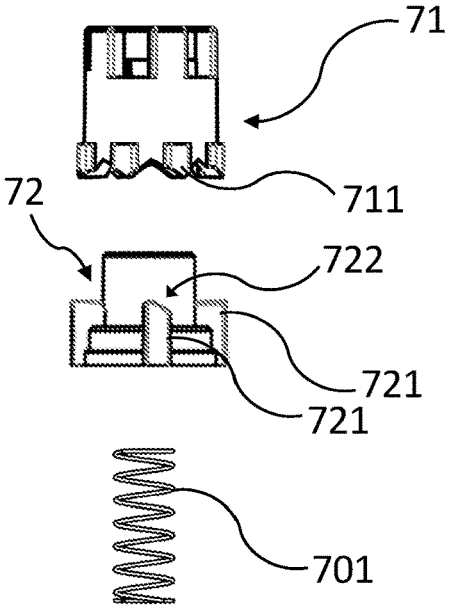

In FIGS. 7D and 7E, the switch assembly 70 consists of a spring 701 that provides a spring force and a cylindrical first body 71 with a plurality of circumferentially arranged teeth 711, located continuously around the back opening of the first body 71 and extending towards a second body 72 at its rearward side. The second body 72 has a plurality of guide ribs 721 on its outer side, and these guide ribs 721 have beveled ends 722. The beveled ends 722 of the guide ribs 721 engage with the circumferentially arranged teeth 711 of the first body 71. When a manual compressive force and the spring force are applied, the guide ribs 721 exert a twisting force relative to the first body 71.

Figure 7G:
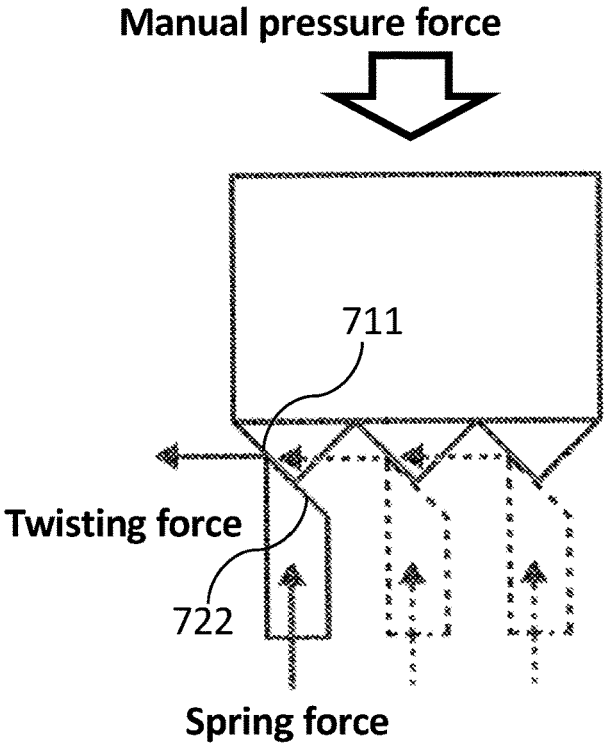
Figure 7F:
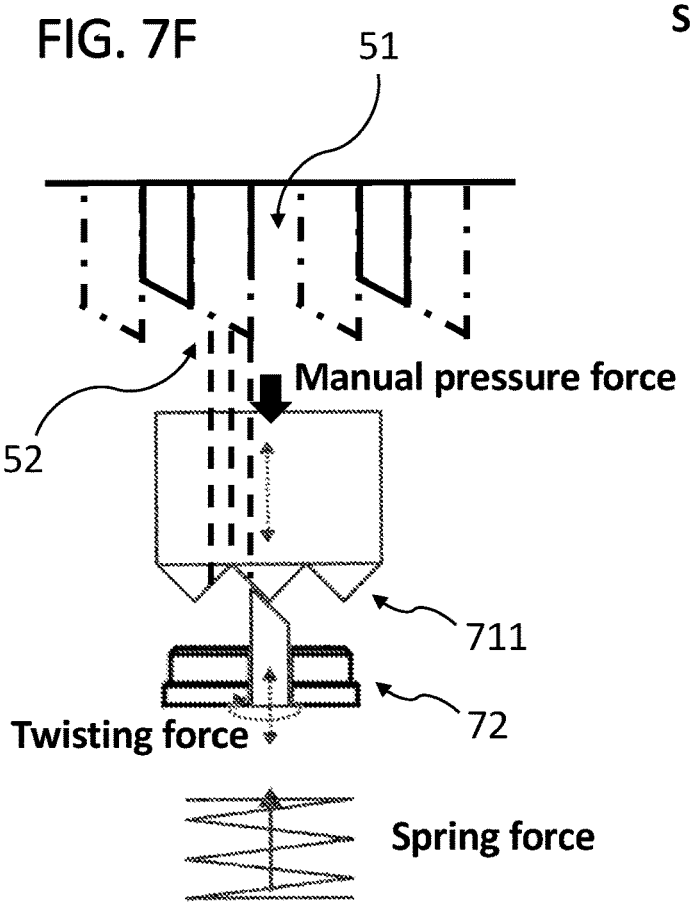

In FIG. 7F, the interaction of the four elements inside an embodiment of the grenade 200 is depicted. The inner surface of the cylindrical shell 501 contains circumferentially arranged guide grooves 51 with different lengths and beveled guides 52. These guide grooves 51 surround the first body 71 and second body 72 after the shell 501 is assembled with the switch assembly 70. The vertical guide grooves 51 ensure that the first body 71 can only move upward and/or downward as needed. The second body 72, however, can move vertically as well as around the axis of rotation.

The guide grooves 51, beveled guides 52, and circumferentially arranged teeth 711 of the first body 71 work together to cause the twisting of the second body 72, acting like a rotor, when the manual pressure force is released. Initially, a horizontal force component is generated between the first body 71 and second body 72, and then between the second body 72 and beveled guides 52. The cylindrical shell 501, with its guide grooves 51 of different lengths and beveled guides 52, provides vertical displacements and horizontal displacements through slanted paths, limiting the horizontal position. This allows the second body 72 to snap into place at preferred vertical positions.

FIG. 7G represents the mechanism required for the twisting action. With the spring 701 continuously exerting an upward force, a horizontal force component is generated at the beveled ends 722, which are attached to the elements. This horizontal force component enables the twisting action, and it can define the states of extend-insert and retract-insert. In other words, the twisting action is facilitated by the horizontal force component at the beveled profiles, ensuring the movement of the second body 72.

Figure 7H:
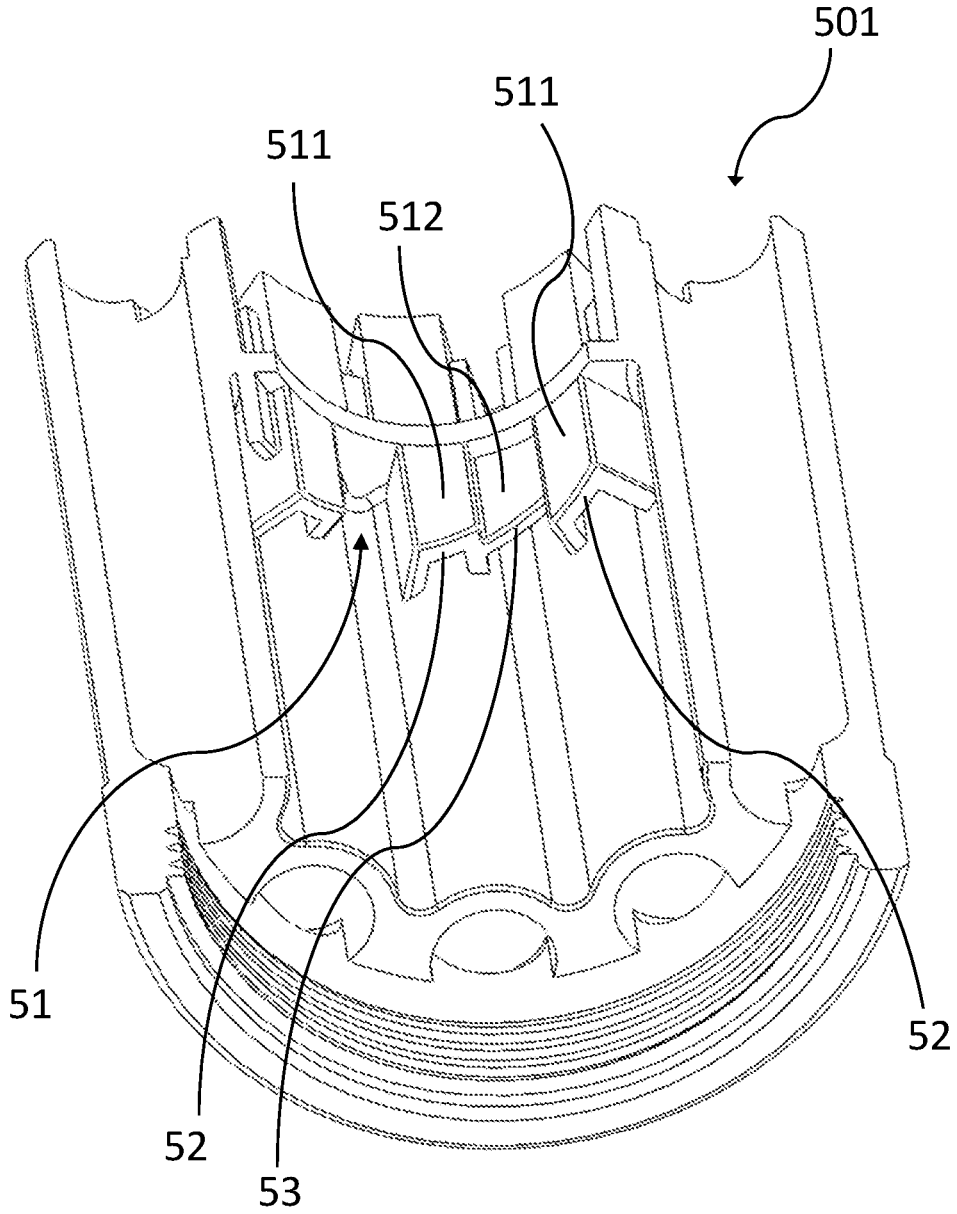

As shown in FIG. 7H, the cylindrical shell 501 is equipped with a plurality of circumferentially arranged inner guide grooves 51, which are defined by main columns 511 extending inwardly from the inner surface of the shell 501. Each main column 511 includes a beveled guide 52 at its bottom side and serves as a means for limiting the horizontal position through the side surfaces of the column 511. Additionally, the cylindrical shell 501 includes a plurality of circumferentially arranged lower columns 512 positioned between two main columns 511. These lower columns 512 also extend inwardly from the inner surface of the shell 501 and have beveled guides 53 at their bottom side. The beveled guides 52 of the main columns 511 and the beveled guides 53 of the lower columns 512 have substantially the same beveled angle.

The height (radial distance between the inner edge of the beveled guides 52 and the inner surface of the shell 501) of the lower columns 512 is lower than the height (radial distance between the inner edge of the beveled guides 53 and the inner surface of the shell 501) of the main columns 511. This height difference allows the lower columns to further restrict the stop positions of the guide ribs 721 and provides a shorter first vertical displacement between the retracted position P1 and the intermediate position P0.

In an embodiment of the grenade 200, which includes the switch assembly 70 firmly attached to the ring interface 20, the cylindrical shell 501 comprises the plurality of circumferentially arranged guide grooves 51 (see FIG. 7F) provided by the main columns 511 and the plurality of circumferentially arranged lower columns 512. This enables the user to axially move the interface 20 relative to the shell 501 between the remote position (P2), the retracted position (P1), and the intermediate position (P0) shown in FIGS. 7B and 7C.

Figure 8A:
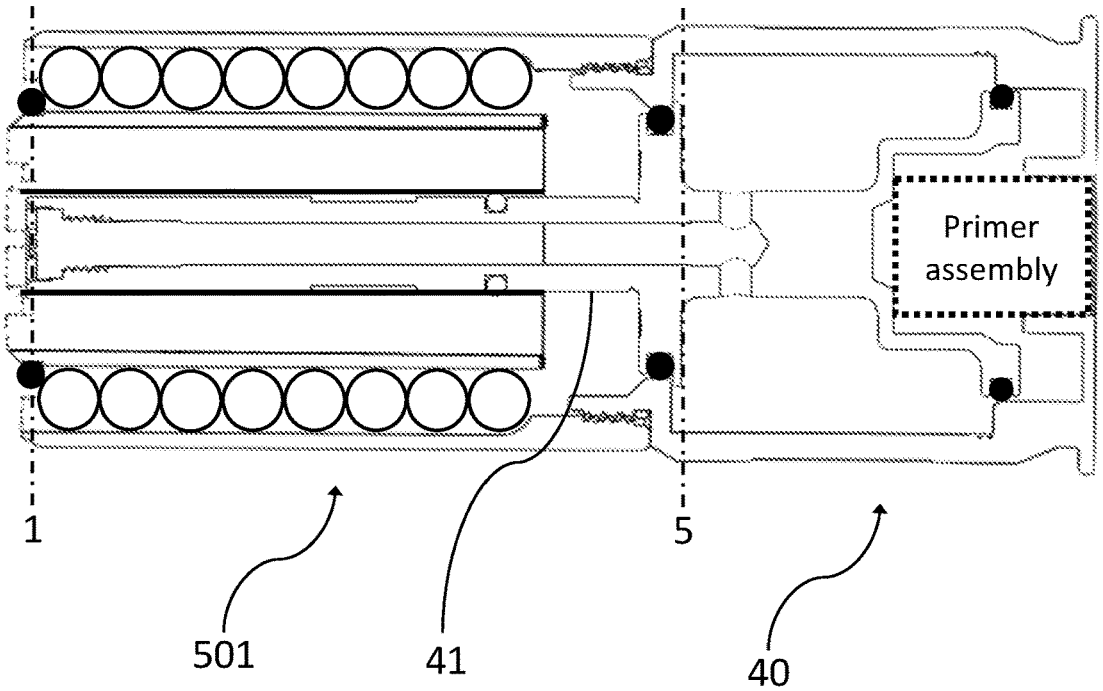
FIGS. 8A-8J illustrate an actuation rod assembly that does not interfere with the ring interface during the launching process.
Figure 8B:
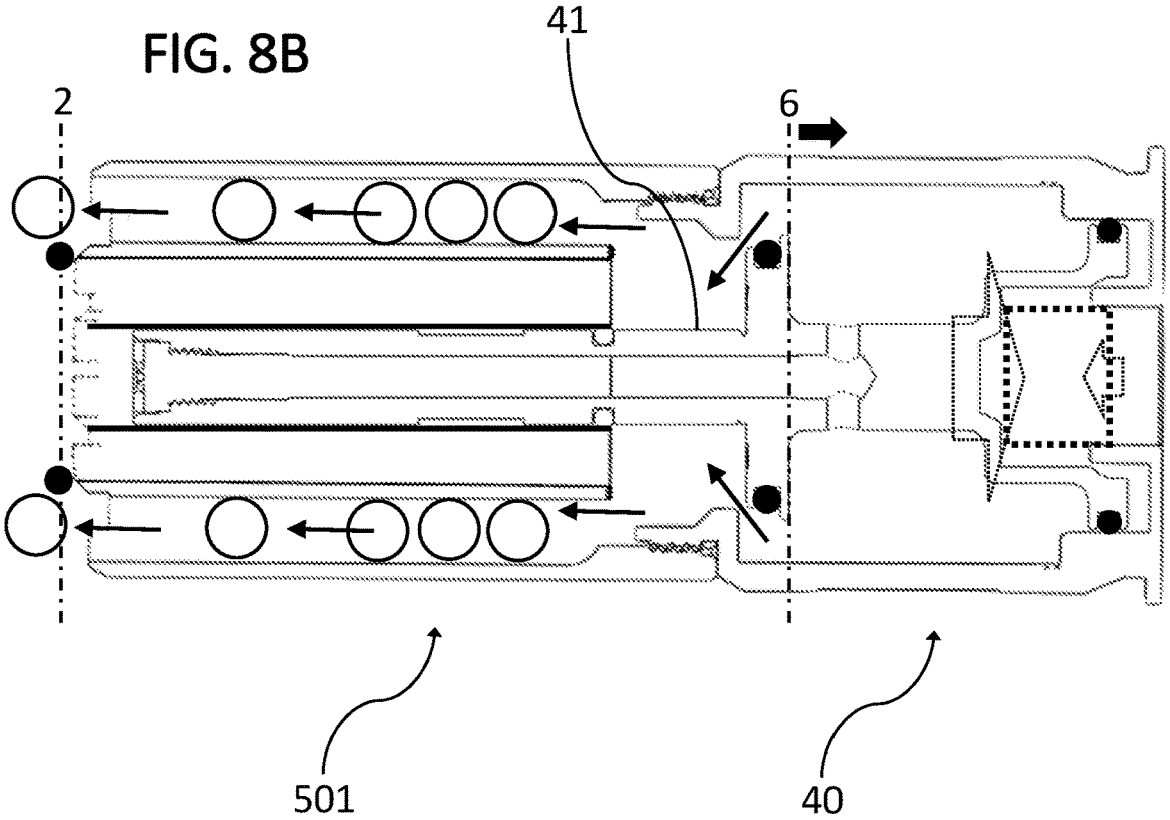

As depicted in FIGS. 8A and 8B, a toy gun grenade may consist of the following components: the cylindrical shell 501, the storage chamber 40, and an actuation rod assembly 41. The storage chamber 40 is connected to the cylindrical shell 501 and can hold compressed air. The actuation rod assembly 41 can move between a fifth location 5 and a sixth location 6.

When the actuation rod assembly 41 is at the fifth location 5, it seals the storage chamber 40, preventing the release of compressed air. However, when it moves toward the sixth location 6, it allows the instantaneous ejection of BBs from the shell by releasing the compressed air. Unlike the actuation rod assembly described in U.S. Pat. No. 8,517,005B2, this embodiment is configured to move rearwardly instead of forwardly. This design ensures that during the launching process, the actuation rod assembly 41 does not interfere with said ring interface 20.

Figure 8C:
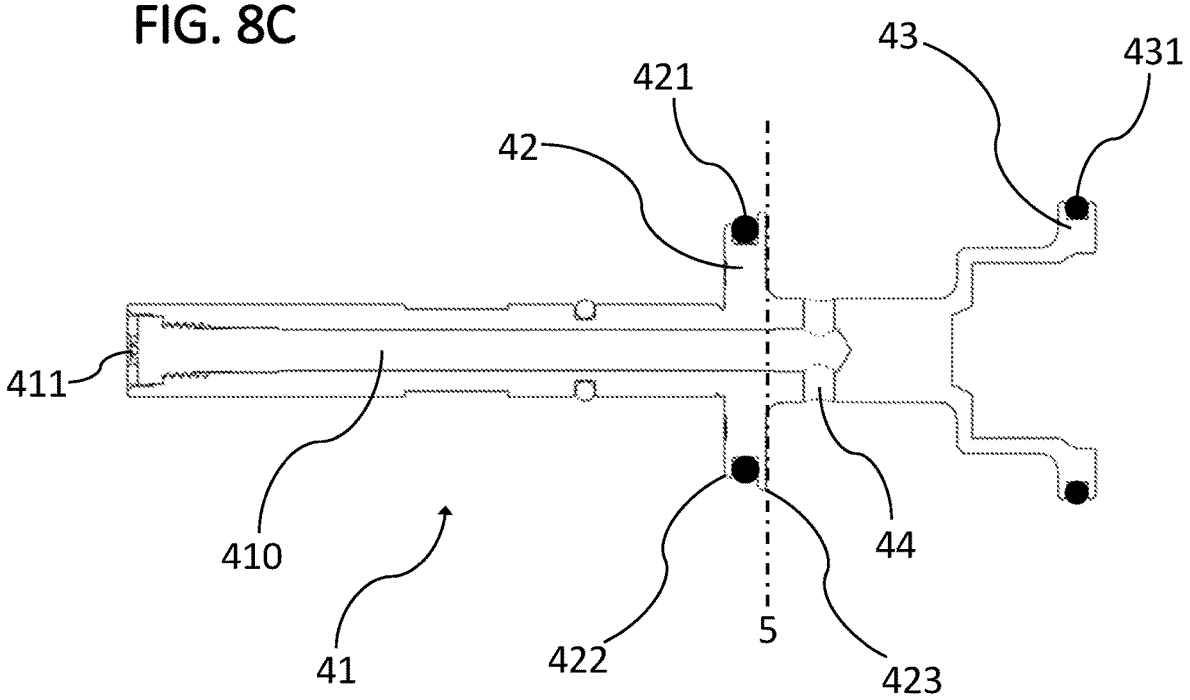
Figure 8D:
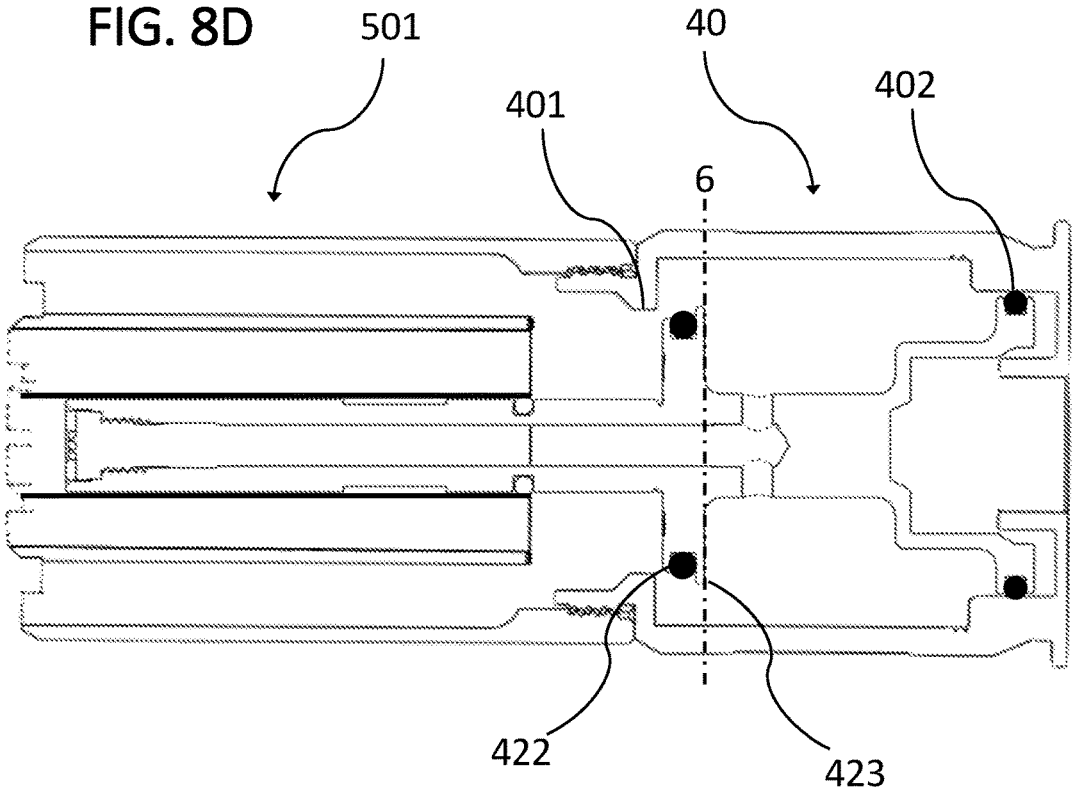

In FIGS. 8C and 8D, the storage chamber 40 is delimited by a first inner edge 401 at the front end and a second inner edge 402 at the rear end. The actuation rod assembly 41 is hollow and is positioned within the central bore of the cylindrical shell 501. It includes an air inlet tube 410 located at the front side, which has an air inlet opening 411 at the front end.

The actuation rod assembly 41 is equipped with a front radial extension 42 and a back radial extension 43 at its rear end. An air output opening 44 is formed between the front and back radial extensions 42 and 43. Gasket rings 421 and 431 are mounted on the circumferences of the front and back radial extensions 42 and 43, respectively. These gasket rings 421 and 431 engage with the first inner edge 401 and the second inner edge 402 of the storage chamber 40, creating a hermetic seal for the storage chamber 40. The front radial extension 42 features a smaller flange 422 on the forward side and a wider flange 423 on the rearward side. This design allows the actuation rod assembly 41 to move only backwardly when releasing the compressed air from the storage chamber 40.

The compressed air enters the storage chamber 40 through the air inlet opening 411 of the air inlet tube 410, accumulating within the chamber. When triggered, a primer assembly (depicted in FIG. 8G) is designed to move the actuation rod assembly 41 backward. This movement disengages the front radial extension 42 from the first inner edge 401 of the storage chamber 40, resulting in the release of the compressed air stored in the chamber and instantaneously ejects the BBs contained in the cylindrical shell 501. In view of the foregoing, an embodiment of the grenade 200, which comprises the actuation rod assembly 41, may comprise: said cylindrical shell including the circumferentially arranged guide portions in front of the tubular nozzle, and the circumferentially arranged guide grooves on the inner surface of the cylindrical shell; said ring interface 20; said switch assembly 70; and the actuation rod assembly 41, wherein the rod assembly 41 is configured to move rearwardly during the launching process, so that the rod assembly 41 will not interfere with said ring interface 20 when launching.

Figure 8E:
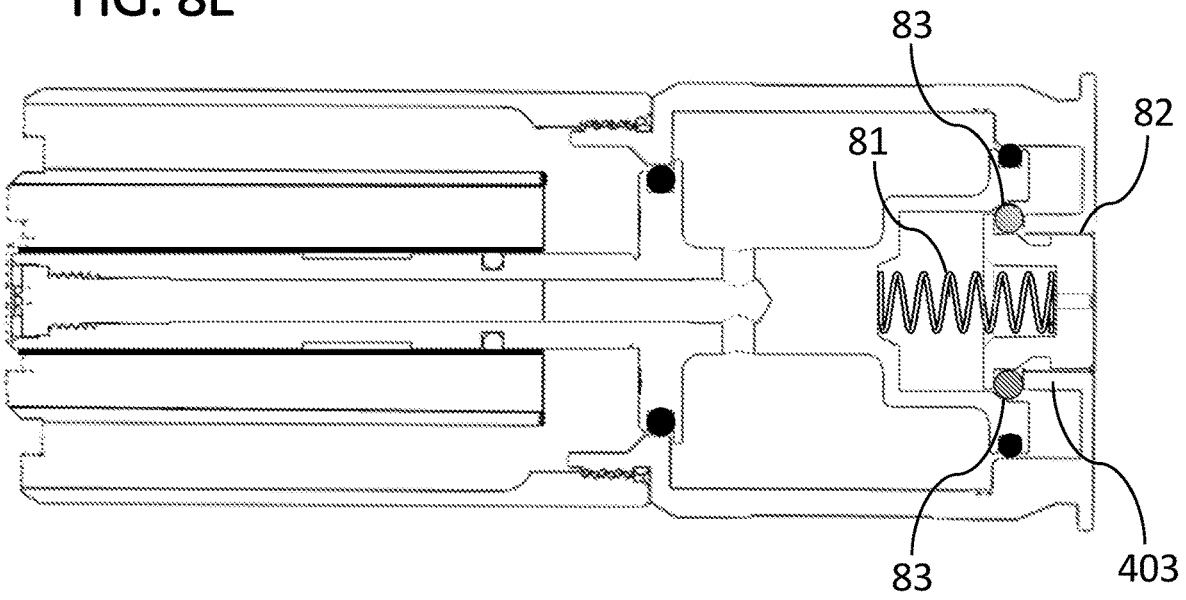
Figure 8F:
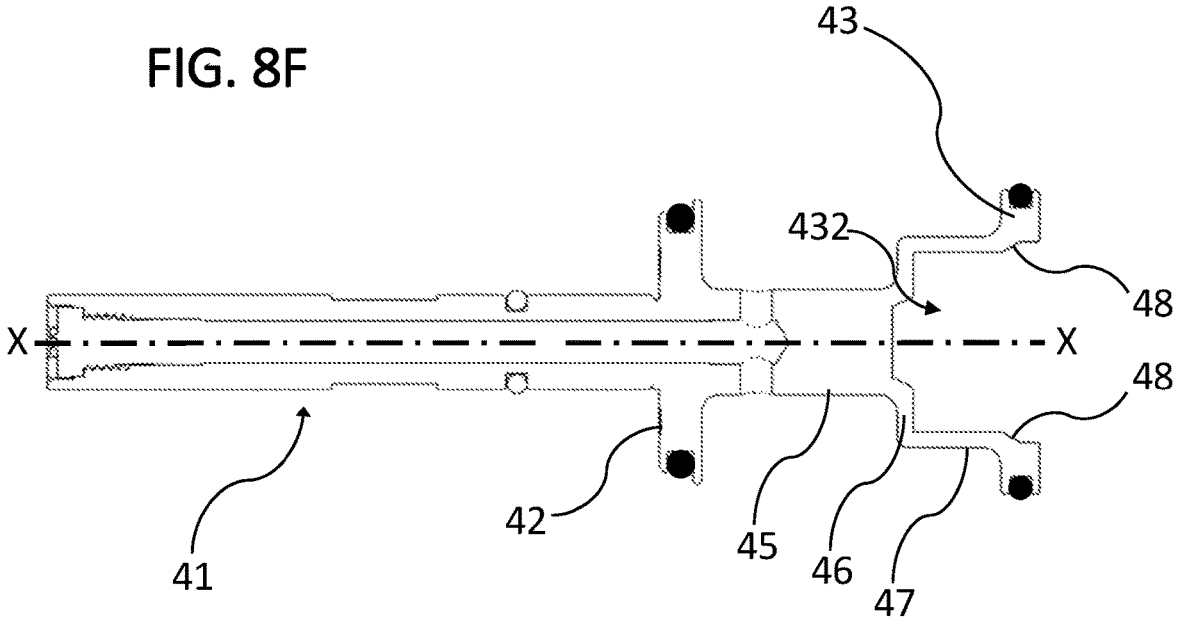

In FIG. 8E, the toy grenade 200 includes the primer assembly located at the rear side of the storage chamber 40. The primer assembly consists of at least one spring 81, a primer 82, and a plurality of steel balls 83. This assembly is responsible for initiating the movement of the actuation rod assembly during the launching process. In FIG. 8F, the actuation rod assembly 41 is depicted. It comprises a pole 45 that extends rearwardly from the center of the front radial extension 42. From the back end of the pole 45, a middle radial extension 46 expands radially. A cylindrical wall 47 extends rearwardly from the outer edge of the middle radial extension 46, symmetrically aligned about the centerline X. The back radial extension 43 expands outwardly from the back edge of the cylindrical wall 47 and features an inner beveled annular surface 48 that extends rearwardly and outwardly from the back opening of the cylindrical wall 47. The cylindrical space 432, enclosed by the middle radial extension 46, cylindrical wall 47, and beveled annular surface 48, serves as a housing for accommodating the primer assembly.

The primer assembly guides the rearward movement of the actuation rod assembly 41 by interacting with the beveled annular surface 48 and a bottom cylindrical wall 403 (shown in FIG. 8E) during the launching process.

Figure 8G:
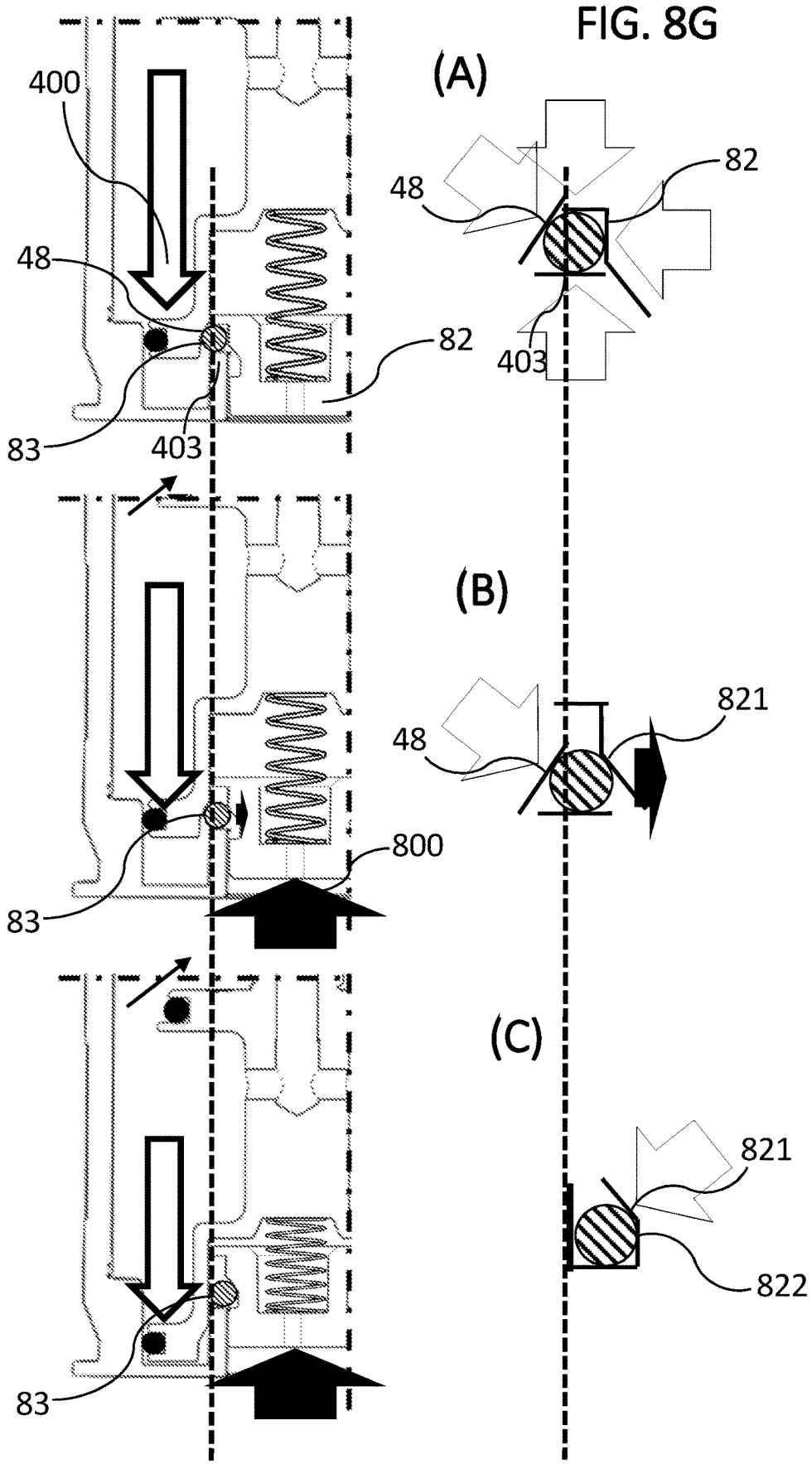

In FIG. 8G, the different states of the primer assembly and the actuation rod assembly are illustrated. In state (A), the storage chamber 40 is charged with compressed air, and a compressed air force 400 is exerted on the actuation rod assembly 41, attempting to move it backward. However, the movement is prevented because the plurality of steel balls 83, along with the beveled annular surface 48, front surface of the bottom cylindrical wall 403, and surfaces of primer 82, hinder its backward motion. In state (B), when a manual force 800 is applied to the primer 82, pushing it forward, a space is created for the steel balls 83 to slide inward. The steel balls 83 are then pushed inward until they reach the position shown in state (C). At this point, the actuation rod assembly 41 is free to move backward until the pressure inside the chamber 40 is not strong enough due to the excessive release of compressed air through the gap 87 depicted in FIG. 8J.

Figure 8H:
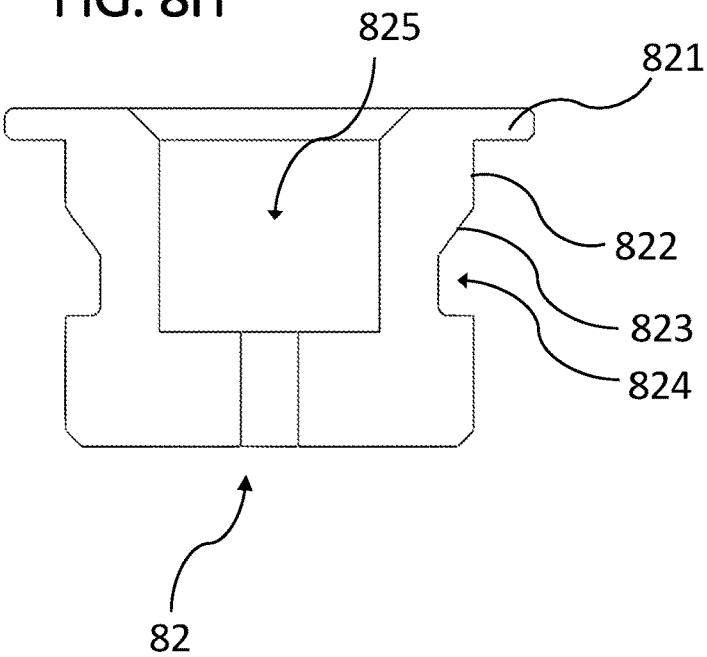
Figure 8I:
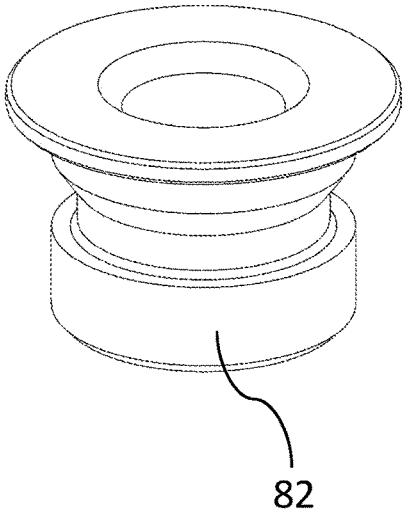
Figure 8J:
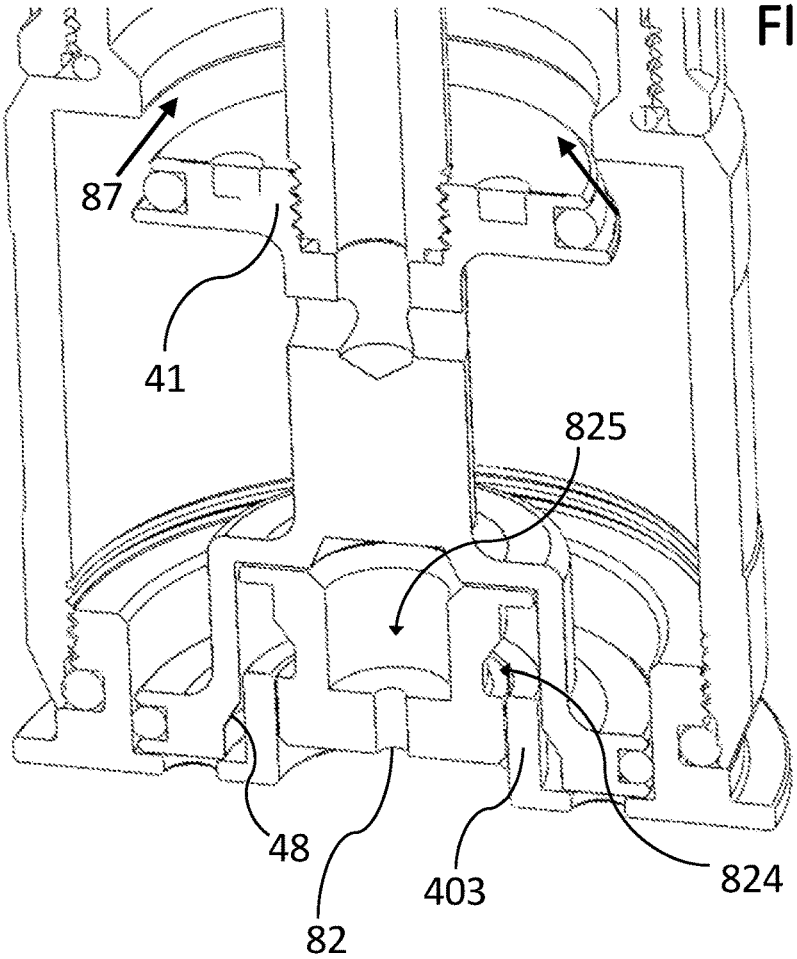

Referring to FIGS. 8H, 8I, and 8J, the primer 82 consists of a top radial extension 821, an outer cylindrical wall 822, a beveled outer annular surface 823, and an annular groove 824. The primer 82 also features a cylindrical inner space 825 to accommodate the spring 81. The top radial extension 821 extends from the top side of the cylindrical wall 822. The beveled outer annular surface 823 extends rearwardly and inwardly from the back edge of the cylindrical wall 822, creating the necessary space for the annular groove 824. In FIG. 8J, a cross-sectional view (showing only partial components) demonstrates that when the primer 82 is pushed forward, the actuation rod assembly 41 moves backward, allowing the release of compressed air from the storage chamber 40 through the gap 87.

Figure 9A:
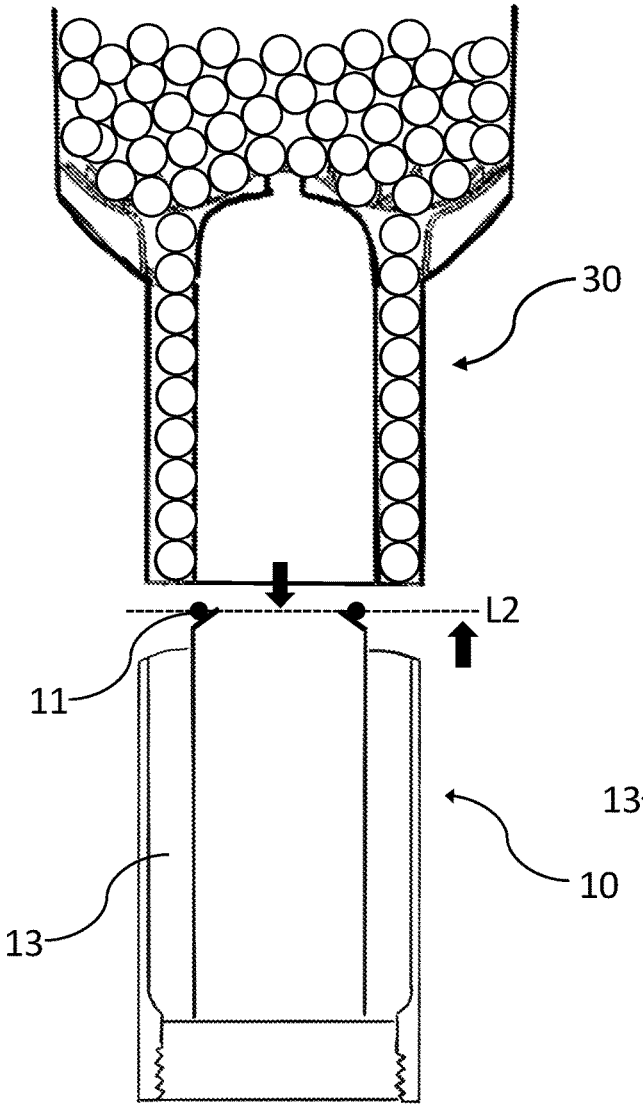
FIGS. 9A-9L illustrate various BBs loading devices in accordance with different embodiments.
Figure 9B:
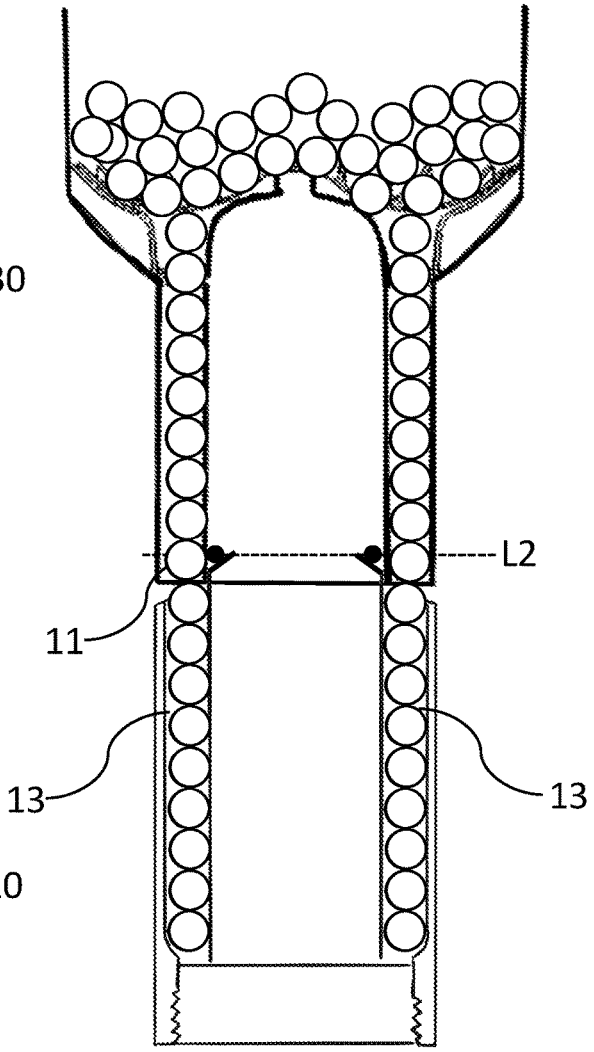
Figure 9C:
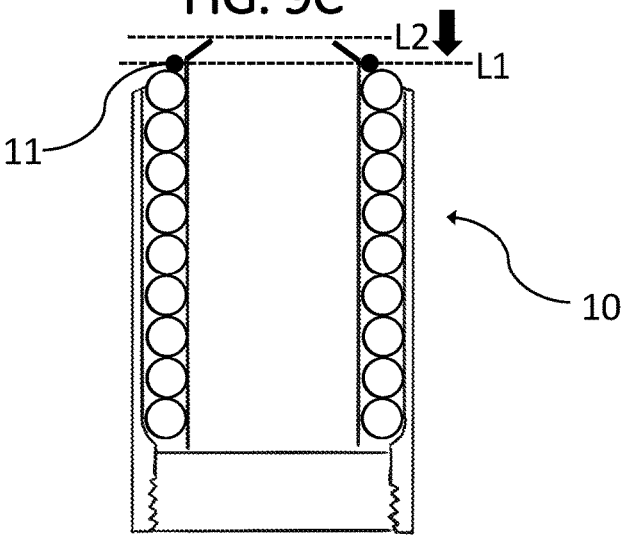

FIGS. 9A-9C illustrate a reloading method inspired by the embodiments of toy grenades described above, wherein each of the extensions in the cylindrical shell comprises a guide portion angled inwardly. This angled guide portion allows the rubber ring to flex inwardly when moved toward the remote ends (L2) of the guide portions, facilitating the reloading process. The method comprises steps: a. Pulling the ring 11 to location L2 and providing the BBs loading device 30, which contains a plurality of BBs for loading; b. Receiving or loading BBs from each of the cylinders 13 into the loading device. This is done by aligning each cylinder with a corresponding BBs queue tube 301 in the loading device and allowing the BBs to transfer from the cylinders to the queue tubes. Once the BBs are loaded, the openings of the queue tubes 301 are blocked to prevent any BBs from falling out; and c. Removing the loading device 30 from the cylindrical shell, and then pushing the ring 11 from location L2 to location L1. This movement of the ring ensures that the loaded BBs are securely held in place and will not fall out before the user intends to launch them.

Figure 9D:
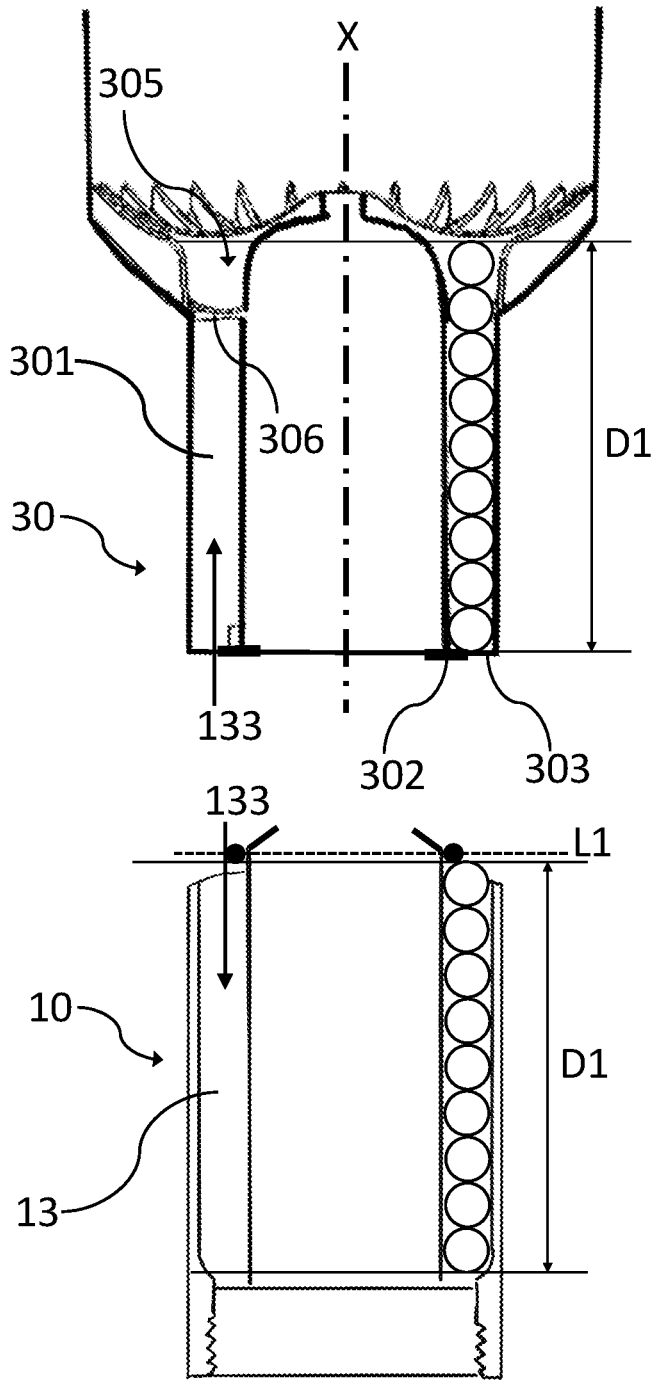

In an embodiment shown in FIG. 9D, the loading device 30 may comprise a plurality of BBs queue tubes 301 located in matching positions relative to the circumferentially arranged cylinders 13. This means that each of the matched queue tubes 301 of the loading device 30 and the cylinders 13 of the cylindrical shell share the same trajectory channel 133. The depth of the queue tubes 301 is labeled as D1, and it corresponds to the height of the BBs that are stacked in parallel within the cylinders 13.

Figure 9E:
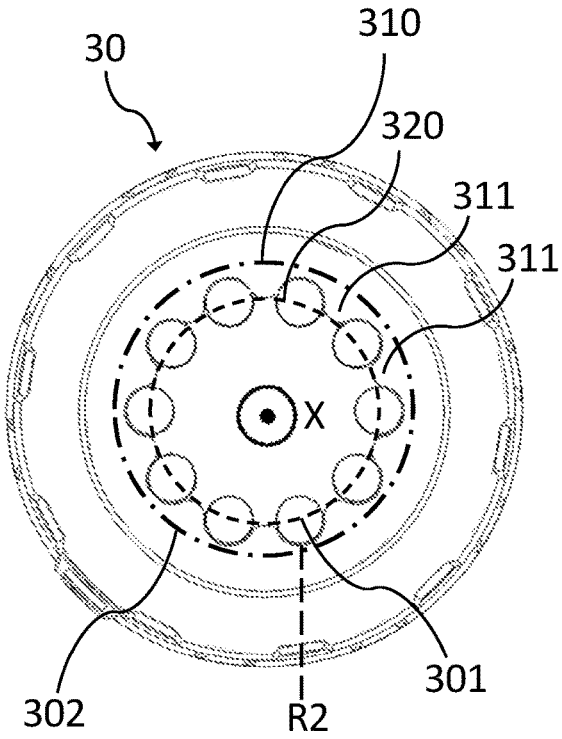
Figure 9G:
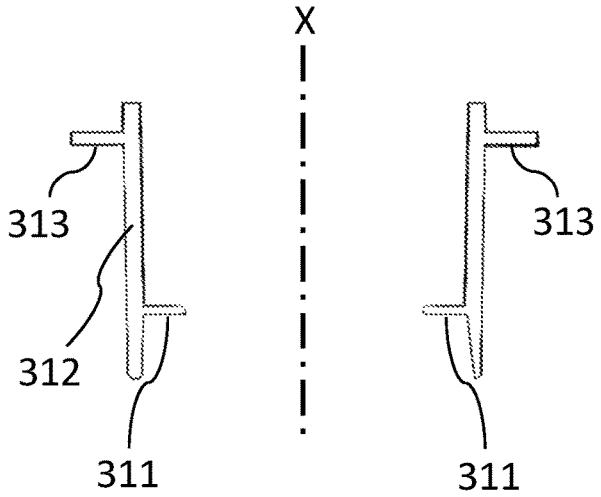
Figure 9F:
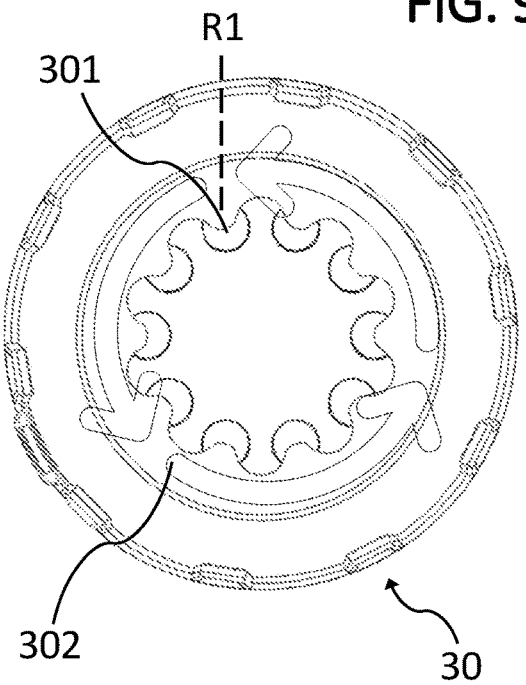

In FIGS. 9E and 9F, the loading device 30 is equipped with a rotation structure 302 located near each bottom opening of the queue tubes 301. This rotation structure 302 has the capability to prevent BBs from dropping off through the bottom openings. The rotation structure 302 can be rotated between position R1 and position R2.

When the rotation structure 302 is in position R1, the blocker portions 311, which extend inwardly from the outer circumference 310 towards the inner circumference 320 of the rotation structure 302, prevent BBs from dropping off. This ensures that the BBs remain securely in place within the queue tubes 301. When the rotation structure 302 is in position R2, it does not interfere with the trajectory channels of the BBs. This allows the BBs to flow freely from the queue tubes 301 into the cylinders without any obstruction. The rotation structure 302 is symmetrical about the centerline X, and its design enables smooth loading of BBs into the grenade while preventing accidental release during the reloading process.

Figure 9H:
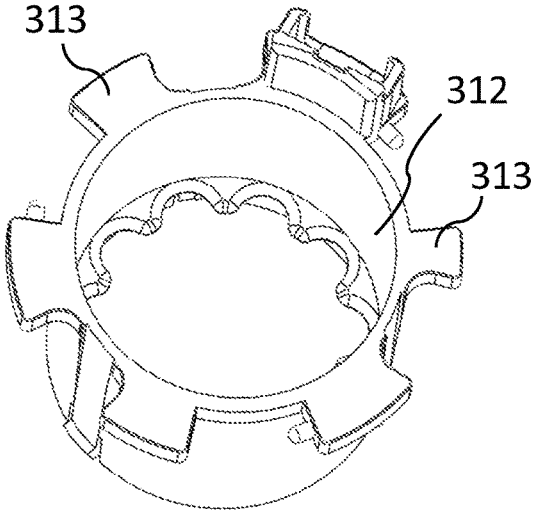
Figure 9I:
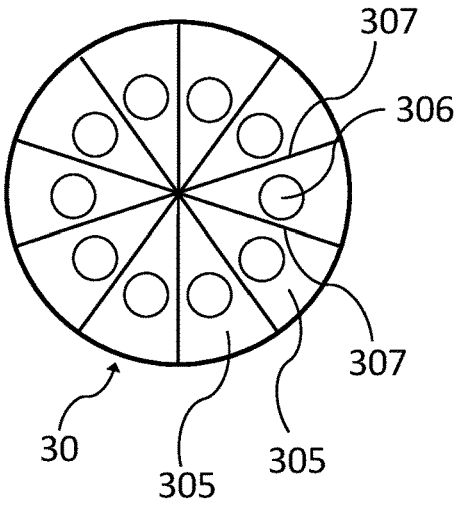

In FIGS. 9G and 9H, the rotation structure 302 is enhanced with an annular wall 312 that extends upwardly from the outer circumference 310. This annular wall 312 includes circumferentially arranged extensions 313 on its outer surface. These extensions 313 serve a purpose in assembling or positioning the rotation structure 302. Moving on to FIG. 91, it provides a top view schematic depiction of the loading device 30. The loading device 30 is divided into multiple sections 305, which are separated by circumferentially arranged distribution walls 307. These distribution walls 307 help distribute the BBs into different sections, ensuring even loading.

Figure 9J:
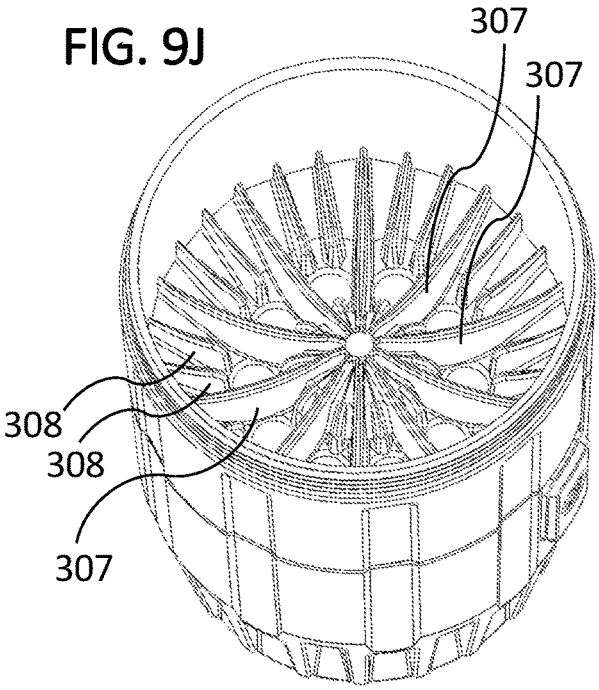
Figure 9K:
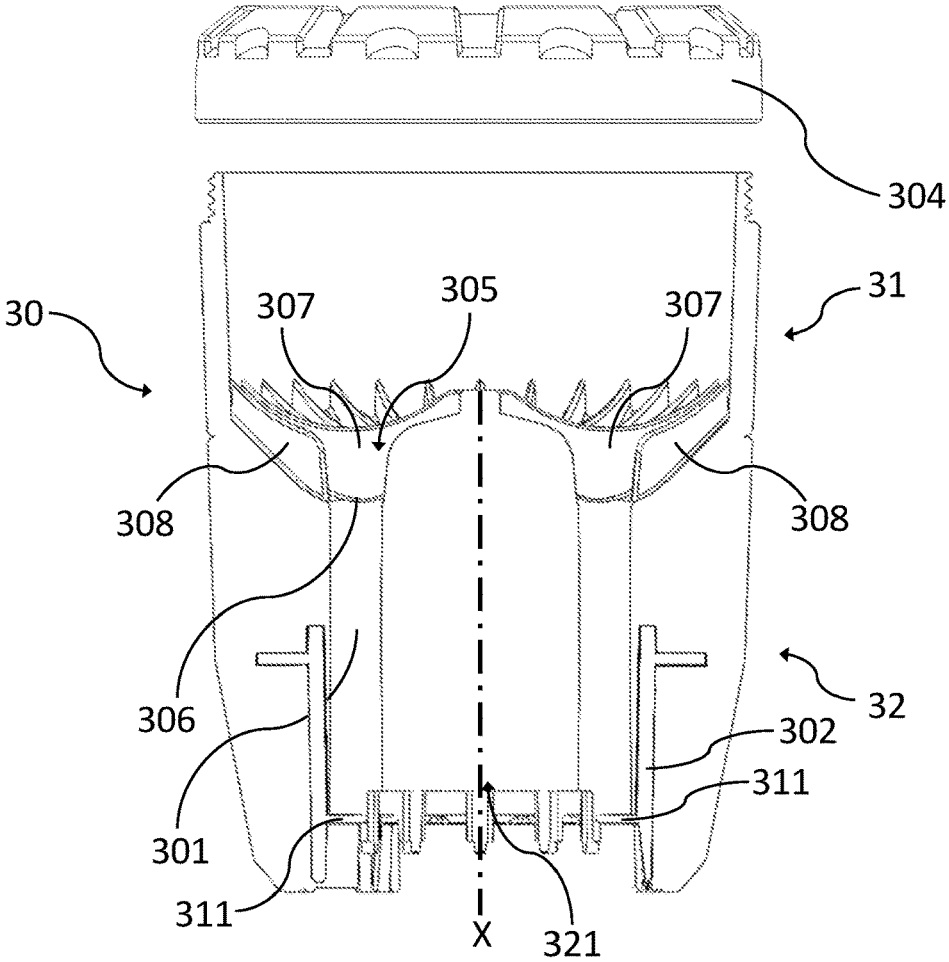
Figure 9L:
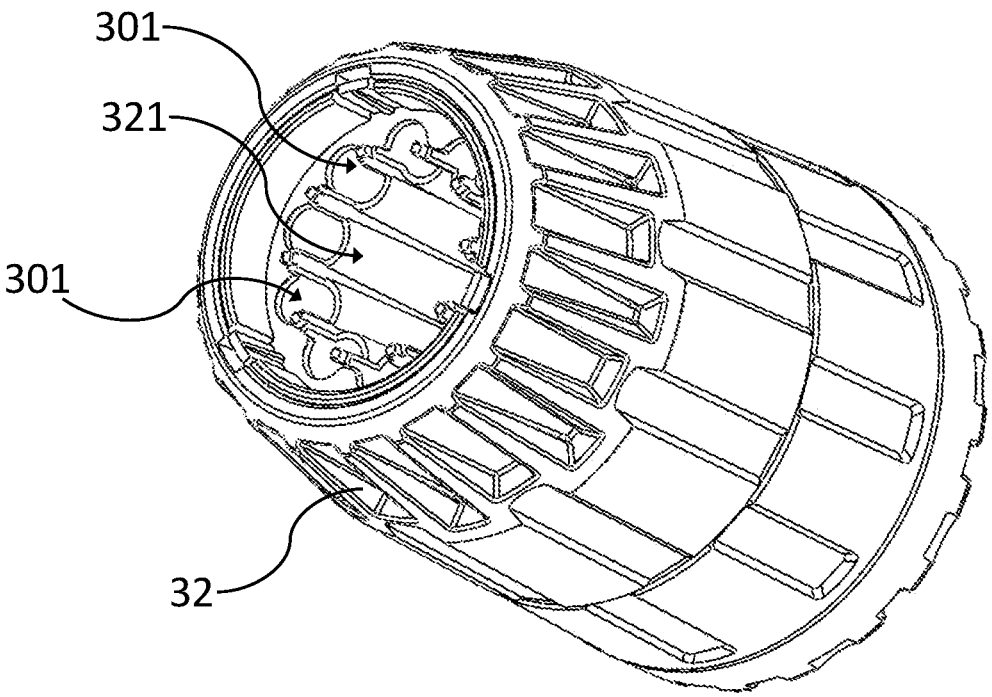

In FIGS. 9J and 9K, another embodiment is presented, featuring curved distribution walls 307 that curve towards the top openings 306 of the queue tubes 301. This curved shape assists in guiding the BBs into the top openings 306 more smoothly. Additionally, shorter distribution walls 308 are placed between two distribution walls 307, adjacent to each top opening 306. These shorter distribution walls 308 further aid in directing the BBs into the top openings 306 with improved efficiency. To facilitate the loading process, once the loading device 30 is filled with BBs, the user can cover the lid 304 and shake the device. This shaking motion helps ensure that the BBs enter the queue tubes 301 smoothly, reducing any potential blockages or jams.

Based on the description provided, an embodiment of the BB bullets loading device for loading a significant number of BBs into a toy grenade can be outlined as follows: the loading device comprises a body that is divided into an upper portion 31 and a lower portion 32. The upper portion 31 consists of circumferentially arranged sections 305, which are separated by distribution walls 307. These distribution walls facilitate the distribution of BBs into different sections within the upper portion. Moving on to the lower portion 32, it features a central opening 321 that is symmetrical about the centerline axis X. This central opening is designed to be releasably coupled to the head portion of toy grenades. Surrounding the central opening, a plurality of circumferentially arranged BBs queue tubes 301 are situated. Each of these queue tubes is connected to the circumferentially arranged sections 305 of the upper portion through top opening 306. At the bottom side of each queue tube 301, there is a corresponding bottom opening 303.

The lower portion 32 includes the rotation structure 302, which consists of circumferentially arranged blocker portions 311 positioned adjacent to the bottom openings of the queue tubes 301. The purpose of this rotation structure is to prevent the BBs within the queue tubes 301 from leaking out through the bottom openings 303. By rotating between position R1 and position R2, the rotation structure ensures that the BBs remain secure and do not drop off when in position R1, while not interfering with the trajectory channels 133 of the BBs when in position R2. This embodiment of the BB bullets loading device provides an efficient mechanism for loading BBs into a toy grenade, ensuring smooth operation and reliable ammunition delivery.

The foregoing embodiments are not limited by any of the details of the description, but rather should be considered broadly within its scope as defined in the appended claims.

For example, in one embodiment, the toy grenade 200 may comprise the cylindrical shell that includes the plurality of circumferentially arranged accommodation cylinders 13, and the plurality of circumferentially arranged extensions 514, wherein each of the extensions may comprise the guide portion 542 angled inwardly for allowing the rubber ring to flex inwardly when moved toward the remote ends of the guide portions 542.

In another embodiment, the grenade 200 may comprise the cylindrical shell, for slidably mounting the flexible rubber ring 11 on the non-continuous annular surface, including a centrally-formed through bore, which is symmetrical about the centerline axis X and has the inner circumference 101, around which the plurality of circumferentially arranged accommodation cylinders 13 are configured to allow each of the cylinders 13 to receive, via the front opening 131 thereof, and load BBs therein. Each of the cylinders 13 includes the back opening 132.

In some embodiment, the cylindrical shell includes the plurality of circumferentially arranged extensions 514, adjacent each of the front openings 131 and the inner circumference 101, over which the extensions 514 are configured to receive (via the plurality of first holding portions 541, which located on the sides facing each of the front openings 131) and hold the flexible rubber ring 11 therein. Each of the extensions 514 comprises the guide portion 542 downstream from each of the first holding portions 541 and angled inwardly from the inner circumference toward the centerline axis X. The plurality of circumferentially arranged first holding portions 541 extend substantially about the centerline axis X to provide the first non-continuous annular surface 1 for receiving and holding the ring 11. The guide portions 542 are configured to allow ring 11 to flex inwardly when being pushed from the first holding portions 541 toward the forward ends of the guide portions 542.

In view of the foregoing, the toy grenade may comprise the cylindrical shell that includes the central bore, around which the plurality of circumferentially arranged accommodation cylinders 13 are configured to allow each of the cylinders 13 to receive BB bullets, the cylindrical shell further including the plurality of circumferentially arranged holding portions 541 (for non-continuous annular surface 1), adjacent each of the front openings 131 (of the cylinders 13), extending about the centerline axis X for providing the first non-continuous annular surface 1 to mount the flexible rubber ring, and the plurality of circumferentially arranged guide portions 542 (for non-continuous annular surface 2), extending from each of the holding portions 541 and angled relative thereto, for providing the second non-continuous annular surface 2 to allow the rubber ring to flex outwardly and inwardly when moving on said annular surfaces (the first and second non-continuous annular surface). The plurality of circumferentially arranged extensions 514 extend substantially about the centerline axis X to define the bore opening 121 through which the interface 20 may be movably mounted therein since there are the plurality of gaps 15 between the plurality of circumferentially arranged extensions 514.

In one embodiment, said bullets loading device 30 comprises a body having an upper portion and a lower portion, wherein the upper portion includes a plurality of circumferentially arranged sections, separated by a plurality of circumferentially arranged distribution walls; and the lower portion includes a central opening, which is symmetrical about a centerline and has an circumference around which a plurality of circumferentially arranged bullets queue tubes are configured to allow each of the queue tubes to receive bullets, via a top opening connected to the circumferentially arranged sections of the upper portion. So that the user may cover a lid on the loading device and then shake it for inputting the bullets into the queue tubes. When coupling the loading device to the toy grenade, the user may further input all the bullets from the queue tubes to the cylinders of the toy grenade at once.

In another embodiment, a toy grenade comprises the cylindrical shell that includes the plurality of circumferentially arranged accommodation cylinders and extensions over which the extensions are configured to slidably mount a flexible rubber ring; the interface 20 disposed adjacent the bore opening of said cylindrical shell and being axially slidable for moving the rubber ring toward preferable locations; the switch assembly 70 for axially moving interface 20 relative to said cylindrical shell between preferable locations: a remote position, a retracted position, and an intermediate position; the storage chamber 40 which is in communication with said cylindrical shell; and the actuation rod assembly 41 that includes the front radial extension and the back radial extension each having a circumference around which the gasket ring is mounted to set the gasket rings in engagement with the first edge and the second edge of storage chamber 40 so as to hermetically seal the storage chamber 40, wherein the front radial extension of the actuation rod assembly has a smaller flange at the forward side than a wider flange at the rearward side for limiting the actuation rod assembly to move backwardly when releasing the compressed air in the storage chamber. Each of the extensions of said cylindrical shell comprises one guide portion angled inwardly for allowing the rubber ring to flex inwardly when moved toward the remote ends of the guide portions. Regarding the guide portion, the term 'remote' means toward the front direction away from the cylindrical shell.

In another embodiment, the toy grenade comprises the cylindrical shell including the plurality of circumferentially arranged extensions, wherein each of the extensions comprising the holding portion and the guide portion angled inwardly. The plurality of circumferentially arranged holding portions extend substantially about the centerline to define the annular surface for slidably mounting the rubber ring. The inwardly angled guide portions is configured to allow the rubber ring to flex inwardly when moved from the holding portions toward the remote ends of the guide portions. Regarding the extensions, the term 'remote' means toward the front direction away from the cylinders.

In view of the foregoing, a reloading method adaptable for use with the cylindrical shell comprising steps: a. pulling the flexible rubber ring from the circumferentially arranged holding portions to the remote ends of the guide portions. b. receiving and loading BB bullets or paintballs from each of the accommodation cylinders. c. pushing the flexible rubber ring from the remote ends of the guide portions back to the circumferentially arranged holding portions. The flexible rubber ring blocks and prevents the BB bullets or paintballs from dropping off only when being at the holding portions. If the user wants to safely unload the large numbers of BB bullets, the user may just move the flexible rubber ring away from the holding portions, and then pour out all bullets.

All changes and modifications that fall within the metes and bounds of the claims are intended to be embraced by the appended claims.

The invention claimed is:

1. A toy grenade for launching large numbers of bullets at a time, comprising:

a cylindrical shell that includes a plurality of circumferentially arranged accommodation cylinders, and a plurality of circumferentially arranged extensions over which the extensions are configured to mount a flexible rubber ring, wherein each of said extensions comprises a guide portion angled inwardly for allowing the flexible rubber ring to flex inwardly when moved toward remote ends of the guide portions.

2. A toy grenade for launching large numbers of bullets at a time, comprising:

a cylindrical shell that includes a central bore, around which a plurality of circumferentially arranged accommodation cylinders, each having a front opening, and are configured to allow each of the accommodation cylinders to receive bullets, the cylindrical shell further including a plurality of circumferentially arranged holding portions, adjacent each of the front openings of the accommodation cylinders, extending about a centerline for providing a first non-continuous annular surface to mount a flexible rubber ring; and a plurality of circumferentially arranged guide portions, extending from each of the holding portions and angled relative thereto, providing a second non-continuous annular surface to allow the flexible rubber ring to flex outwardly and inwardly when moving on said annular surfaces.

* * * * *